US007702256B2

(12) United States Patent
Nukada et al.

(10) Patent No.: US 7,702,256 B2
(45) **Date of Patent: *Apr. 20, 2010**

(54) IMAGE-FORMING APPARATUS INCLUDING AN ELECTROPHOTOGRAPHIC PHOTORECEPTOR HAVING AN UNDERCOAT LAYER WITH METAL OXIDE PARTICLES AND AN ACCEPTOR COMPOUND

(75) Inventors: Hidemi Nukada, Minamiashigara (JP); Hirofumi Nakamura, Minamiashigara (JP); Taketoshi Hoshizaki, Minamiashigara (JP); Yu Qi, Oakville (CA); Nan-Xing Hu, Oakville (CA); Ah-Mee Hor, Mississauga (CA)

(73) Assignees: Fuji Xerox Co., Ltd., Tokyo (JP); Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/083,285

(22) Filed: Mar. 18, 2005

(65) Prior Publication Data

US 2006/0013616 A1 Jan. 19, 2006

(30) Foreign Application Priority Data

Jul. 16, 2004 (JP) ..... 2004-210750

(51) Int. Cl.
*G03G 15/00* (2006.01)

(52) U.S. Cl. ..... 399/159; 399/167; 430/60; 430/65

(58) Field of Classification Search ..... 399/167, 399/159

See application file for complete search history.

(56) References Cited

U.S. PATENT DOCUMENTS

| | | | |
|---|---|---|---|
| 4,264,695 | A | 4/1981 | Kozima et al. |
| 4,265,990 | A | 5/1981 | Stolka et al. |
| 4,298,697 | A | 11/1981 | Baczek et al. |
| 4,338,390 | A | 7/1982 | Lu |
| 4,560,635 | A | 12/1985 | Hoffend et al. |

(Continued)

FOREIGN PATENT DOCUMENTS

CN 1105128 A * 7/1995

(Continued)

OTHER PUBLICATIONS

Varcum 29159 Data Sheet, Durez Corp. (Jul. 13, 2005).

(Continued)

*Primary Examiner*—David M Gray
*Assistant Examiner*—Laura K Roth
(74) *Attorney, Agent, or Firm*—Oliff & Berridge, PLC

(57) ABSTRACT

An image forming apparatus comprising an electrophotographic photoreceptor, a charging unit, an exposure unit, a development unit, and a transfer unit, wherein the image forming apparatus conducts charging, exposure, development, and transfer while moving a circumferential surface of the electrophotographic photoreceptor in a predetermined direction, the image forming apparatus further comprises a controlling unit which controls a moving velocity of the circumferential surface of the electrophotographic photoreceptor so that a time required for processes from charging to development is changeable, the electrophotographic photoreceptor includes an undercoat layer and a photosensitive layer, and the undercoat layer includes a metal oxide particle and an acceptor compound having a group capable of reacting with the metal oxide particle.

12 Claims, 2 Drawing Sheets

U.S. PATENT DOCUMENTS

| | | | | |
|---|---|---|---|---|
| 4,778,671 | A | | 10/1988 | Wusirika |
| 4,792,507 | A | | 12/1988 | Yoshihara et al. |
| 5,008,706 | A | | 4/1991 | Ohmori et al. |
| 5,102,757 | A | | 4/1992 | Akasaki et al. |
| 5,363,176 | A | | 11/1994 | Ishihara et al. |
| 5,430,526 | A | | 7/1995 | Ohkubo et al. |
| 5,446,011 | A | | 8/1995 | Hayakawa et al. |
| 5,486,440 | A | | 1/1996 | Kashizaki et al. |
| 5,795,690 | A | * | 8/1998 | Takegawa et al. |
| 5,891,594 | A | | 4/1999 | Yuh et al. |
| 5,958,638 | A | | 9/1999 | Katayama et al. |
| 5,965,311 | A | | 10/1999 | Suzuki |
| 5,972,550 | A | | 10/1999 | Tamura et al. |
| 6,137,976 | A | * | 10/2000 | Itaya et al. |
| 6,183,869 | B1 | | 2/2001 | Okuda et al. |
| 6,190,811 | B1 | | 2/2001 | Tanaka et al. |
| 6,277,535 | B1 | | 8/2001 | Liu et al. |
| 6,284,421 | B1 | | 9/2001 | Matsuzaki et al. |
| 6,453,139 | B2 | | 9/2002 | Sasame et al. |
| 6,455,222 | B1 | | 9/2002 | Fukino et al. |
| 6,623,655 | B1 | | 9/2003 | Kappel et al. |
| 6,773,857 | B2 | | 8/2004 | Nakamura et al. |
| 6,795,690 | B2 | | 9/2004 | Weissman et al. |
| 6,921,618 | B2 | | 7/2005 | Hongo et al. |
| 6,924,076 | B2 | | 8/2005 | Saiki et al. |
| 6,946,226 | B2 | | 9/2005 | Wu et al. |
| 7,153,574 | B2 | | 12/2006 | Qi et al. |
| 2002/0025179 | A1 | * | 2/2002 | Toyohara et al. |
| 2003/0118927 | A1 | * | 6/2003 | Nakamura et al. ..... 399/159 |
| 2004/0161684 | A1 | | 8/2004 | Wu et al. |
| 2005/0042533 | A1 | | 2/2005 | Wu et al. |
| 2005/0207788 | A1 | | 9/2005 | Bandou et al. |
| 2006/0013615 | A1 | | 1/2006 | Nukada et al. |
| 2006/0013616 | A1 | | 1/2006 | Nukada et al. |
| 2006/0014090 | A1 | | 1/2006 | Shiino et al. |
| 2006/0014091 | A1 | | 1/2006 | Nukada et al. |
| 2006/0014092 | A1 | | 1/2006 | Nukada et al. |
| 2006/0029872 | A1 | | 2/2006 | Qi et al. |

FOREIGN PATENT DOCUMENTS

| | | | |
|---|---|---|---|
| CN | 1207635 | C | 3/2003 |
| CN | 1403879 | | 3/2003 |
| EP | 0 810 481 | A2 | 12/1997 |
| EP | 1 286 225 | | 11/2005 |
| EP | 1286225 | | 11/2005 |
| JP | A 60-218655 | | 11/1985 |
| JP | A 61-80158 | | 4/1986 |
| JP | B2 61-35551 | | 8/1986 |
| JP | A 61-204640 | | 9/1986 |
| JP | 63-142362 | | 6/1988 |
| JP | 7-175249 | | 7/1995 |
| JP | 8-044097 | | 2/1996 |
| JP | 9-197701 | | 7/1997 |
| JP | A-9-218592 | | 8/1997 |
| JP | 11-095472 | A | 4/1999 |
| JP | 2000-321805 | A | 11/2000 |
| JP | A 2003-241511 | | 8/2003 |
| JP | 2004-093792 | A | 3/2004 |
| JP | 2004-126069 | | 4/2004 |
| JP | 2004-126069 | A | 4/2004 |

OTHER PUBLICATIONS

Grant & Hackh's Chemical Dictionary, Fifth edition, p. 268, 1987.
Nukada et al., U.S. Appl. No. 11/081,651, filed Mar. 17, 2005.

* cited by examiner

IMAGE-FORMING APPARATUS INCLUDING AN ELECTROPHOTOGRAPHIC PHOTORECEPTOR HAVING AN UNDERCOAT LAYER WITH METAL OXIDE PARTICLES AND AN ACCEPTOR COMPOUND

CROSS-REFERENCE TO RELATED APPLICATION

This application claims priority under 35 U.S.C. 119 from Japanese patent Application No. 2004-210750, the disclosure of which is incorporated by reference herein.

BACKGROUND OF THE INVENTION

1. Field of the Invention

This invention is related to image forming apparatuses and process cartridges.

2. Description of the Related Art

The electrophotography is used in electrophotographic apparatuses such as copy machines and laser beam printers since the electrophotography enables high-speed, high-quality printing.

In general, the photoreceptors used in the electrophotographic apparatuses have been organic photoreceptors containing photoconductive organic materials, recently. Regarding the constitutions of the photoreceptors, separated function photoreceptors have been used in which a charge generating material and a charge transfer material are dispersed in different layers (charge generating layer and charge transfer layer).

In recent years, office functions have been improved in quality and in speed; there have been demands for faster and colorized document processing and faster, colorized, high-quality image forming apparatuses (copying machines, printers, facsimile machines, etc.) for processing the documents. In order to satisfy the demands, tandem-type color image forming apparatuses have been proposed and commercialized. A tandem-type color image forming apparatus has separate image forming units for respective colors of black (K), yellow (Y), magenta (M), and cyan (C). The tandem-type color image forming apparatus forms images of different colors in the respective image forming units, then transfers the images onto a transfer member or an intermediate transfer member so that the images overlap, thus forming a color image.

In the color image forming apparatuses, techniques have been proposed (for example in Japanese Patent Application Laid-Open (JP-A) No. 2003-241551) which can switch between different image formation modes in accordance with the image and the kind of the image receiving medium, thus realizing high quality and high efficiency. For example, only the black toner is used when black-and-white image is formed, whereby the process speed can be supposedly higher than in the color image formation. A high-quality image can supposedly be formed by lengthening the time required for the image formation when the image receiving medium is heavy paper or an OHP sheet, in both cases of color image forming apparatuses and monochromatic image forming apparatuses.

However, if the time required for the processes from charging to development varies as in the above techniques, the image quality tends to be insufficient. When the image formation mode is switched to another image formation mode, the time required for the processes from charging to development changes, but photoreceptors sufficiently adaptable to the change in the use condition have not been developed. Therefore, in such techniques, there have been a problem that, when image formation is conducted in a process condition in which a longer time is required for the processes from charging to development, fogging and black spots develop severely and image memory easily occurs.

SUMMARY OF THE INVENTION

The invention has been made in consideration of the above problems of the conventional techniques.

An aspect of the invention is to provide an image forming apparatus comprising an electrophotographic photoreceptor, a charging unit, an exposure unit, a development unit, and a transfer unit. The image forming apparatus conducts charging, exposure, development, and transfer while moving the circumferential surface of the electrophotographic photoreceptor in a predetermined direction. The image forming apparatus further comprises a controlling unit. The controlling unit controls the moving velocity of the circumferential surface of the electrophotographic photoreceptor so that the time required for the processes from charging to development is changeable. The electrophotographic photoreceptor includes an undercoat layer and a photosensitive layer. The undercoat layer includes a metal oxide particle and an acceptor compound having a group capable of reacting with the metal oxide particle.

When the image forming apparatus of the invention is used, the electrophotographic characteristic of the electrophotographic photoreceptor is sufficiently high even when the time required for the processes from charging to development is long. Accordingly, the image formation can be conducted in various conditions when the image forming apparatus of the invention is used. This effect is caused by the inclusion of the acceptor compound having a group capable of reacting with the metal oxide particle in the undercoat layer. Even when the time required for the processes from charging to development is varied in the image forming apparatus of the invention, the development of the fogging and black spots on the obtained image and the image memory can be sufficiently suppressed.

The inventors suppose that the reason why the above effects are obtained is as described below.

First, the reason why the conventional image forming apparatuses have the above problems is described. The undercoat layer used in a conventional electrophotographic receptor is obtained by: dispersing metal oxide pigments and a binder resin in a solvent and applying the obtained dispersing liquid. If the thickness of the undercoat layer is larger than 5 μm, a large amount of metal oxide particles are incorporated into the undercoat layer in order to form a conductive path which secures a sufficient charge transporting ability in the undercoat layer. In this case, a part of the metal oxide particles are not covered by the binder resin but exposed. The exposed metal oxide particles form a charge injection site. The charge injection site works as the point at which charge is injected to the upper layer. When the processes from charging to development take a long time, the charge injected to the upper layer can move to the surface of the photoreceptor and cancel the surface charge to cause fogging or black spots. If the resistance of the undercoat layer is excessively low, the charge injection to the upper layer occurs intensely to cause severe fogging. On the other hand, when the resistance of the undercoat layer is excessively high, the image defects such as fogging can be prevented; however, the charge tends to accumulate in the undercoat layer or on the interface between the undercoat layer and the upper layer, whereby the residual potential becomes high owing to the charge accumulated during continuous or longtime use. The high residual potential causes defects in the image density, thereby deteriorating the image quality.

Accordingly, the undercoat layer has to have both of the resistance controlling function and the charge injection controlling function. This requirement have imposed a tight restriction to the design.

As the result of the intensive study carried out by the inventors of the present invention, the following advantages of the electrophotographic photoreceptor of the invention have been found. The electrophotographic photoreceptor of the invention has an undercoat layer including a metal oxide particle and an acceptor compound having a group capable of reacting with the metal oxide particle. When the photoreceptor of the invention is used in the image forming apparatus of the invention, it is possible to prevent the accumulation of the charge in the undercoat layer and the accumulation of the charge in the neighborhood of the interface between the undercoat layer and the upper layer. Therefore, in the image forming apparatus of the invention, potential defects such as the decrease in electric potential during repetitive use is prevented, and it is possible to conduct sufficient and uniform charging.

Because of the above advantages, the image forming apparatus of the invention realizes better electric characteristics and image quality characteristics than conventional image forming apparatuses can realize. Even if the time required for the processes from charging to development is changed, the fogging and black spots of the obtained image, and the image memory are sufficiently suppressed. Even if the image forming apparatus is used continuously for a long time, the variation in the electric characteristics is small and it is possible to sufficiently suppress the occurrence of the image density defect.

Accordingly, formation of high-quality image and long life are realized by the image forming apparatus of the invention, whereby the invention has been made.

An aspect of the invention is to provide an image forming apparatus comprising an electrophotographic photoreceptor, a charging unit, an exposure unit, a development unit, and a transfer unit, wherein:

the image forming apparatus conducts charging, exposure, development, and transfer while moving the circumferential surface of the electrophotographic photoreceptor in a predetermined direction;

the image forming apparatus further comprises a controlling unit which controls the moving velocity of the circumferential surface of the electrophotographic photoreceptor so that the time required for the processes from charging to development is changeable;

the electrophotographic photoreceptor includes an undercoat layer and a photosensitive layer; and the undercoat layer includes a metal oxide particle and an acceptor compound having a group capable of reacting with the metal oxide particle.

Another aspect of the invention is to provide a color image forming apparatus comprising a plurality of image forming units, wherein:

each image forming unit includes an electrophotographic photoreceptor, a charging unit, an exposure unit, a development unit, and a transfer unit;

each image forming unit conducts charging, exposure, development, and transfer while moving the circumferential surface of the electrophotographic photoreceptor in a predetermined direction;

each image forming unit further includes a controlling unit which controls the moving velocity of the circumferential surface of the electrophotographic photoreceptor so that the time required for the processes from charging to development is changeable;

the electrophotographic photoreceptor includes an undercoat layer and a photosensitive layer; and the undercoat layer includes a metal oxide particle and an acceptor compound having a group capable of reacting with the metal oxide particle.

Another aspect of the invention is to provide a process cartridge comprising an electrophotographic photoreceptor and at least one selected from the group consisting of a charging unit, a development unit, a transfer unit, and a cleaning unit, wherein:

the process cartridge is attachable to an image forming apparatus and detachable from the image forming apparatus;

the image forming apparatus conducts charging, exposure, development, and transfer while moving the circumferential surface of the electrophotographic photoreceptor in a predetermined direction;

the process cartridge further includes a controlling unit which controls the moving velocity of the circumferential surface of the electrophotographic photoreceptor so that the time required for the processes from charging to development is changeable;

the electrophotographic photoreceptor includes an undercoat layer and a photosensitive layer; and the undercoat layer includes a metal oxide particle and an acceptor compound having a group capable of reacting with the metal oxide particle.

In all the aspects, the following constitution may be selected.

The controlling unit may be such a controlling unit that the controlling unit can control the moving velocity of the circumferential surface of the electrophotographic photoreceptor while satisfying the conditions represented by the following formulae (1) and (2) and that the controlling unit can switch among a plurality of control modes including a normal mode, a low-speed mode, and a high-speed mode.

$$T_{low} \leqq (1/3)T \quad \text{Formula (1):}$$

$$T_{high} \geqq 3T \quad \text{Formula (2):}$$

(In the formulae, T represents the time between charging and development in the electrophotographic process in the normal mode; $T_{low}$ represents the time between charging and development in the electrophotographic process in the low-speed mode; and $T_{high}$ represents the time between charging and development in the electrophotographic process in the high-speed mode.)

The acceptor compound may be a compound having an quinone group. The acceptor compound may be a compound having an anthraquinone structure. The acceptor compound may be selected from anthraquinone, hydroxyanthraquinone, aminoanthraquinone, and aminohydroxyanthraquinone.

In an embodiment, the metal oxide particle has been subjected to a surface treatment with a coupling agent. The coupling agent may be a silane coupling agent. The silane coupling agent may have an amino group.

The metal oxide particle may be selected from titanium oxide, zinc oxide, tin oxide, and zirconium oxide.

The electrophotographic photoreceptor may have an outermost layer including an organic or inorganic particle. The particle in the outermost layer may be a fluorine-containing resin particle.

The charge generating layer of the electrophotographic photoreceptor may include a phthalocyanine pigment or an azo pigment. The charge generating layer may include a hydroxygallium phthalocyanine pigment, a chlorogallium phthalocyanine pigment, an oxytitanyl phthalocyanine pigment, or a non-metallic phthalocyanine pigment.

The charging unit may be a contact charging unit which charge the electrophotographic photoreceptor by contacting the electrophotographic photoreceptor.

The transfer unit may use the intermediate transfer method in which a toner image formed on the circumferential surface of the electrophotographic photoreceptor is transferred indirectly to an image receiving medium via an intermediate transfer member.

DESCRIPTION OF THE PRESENT INVENTION

Preferable embodiments of the invention will be explained in detail, occasionally referring to the figures. In the figures, the same or corresponding members are designated by the same sign, and overlapping descriptions are omitted.

Figure 1:
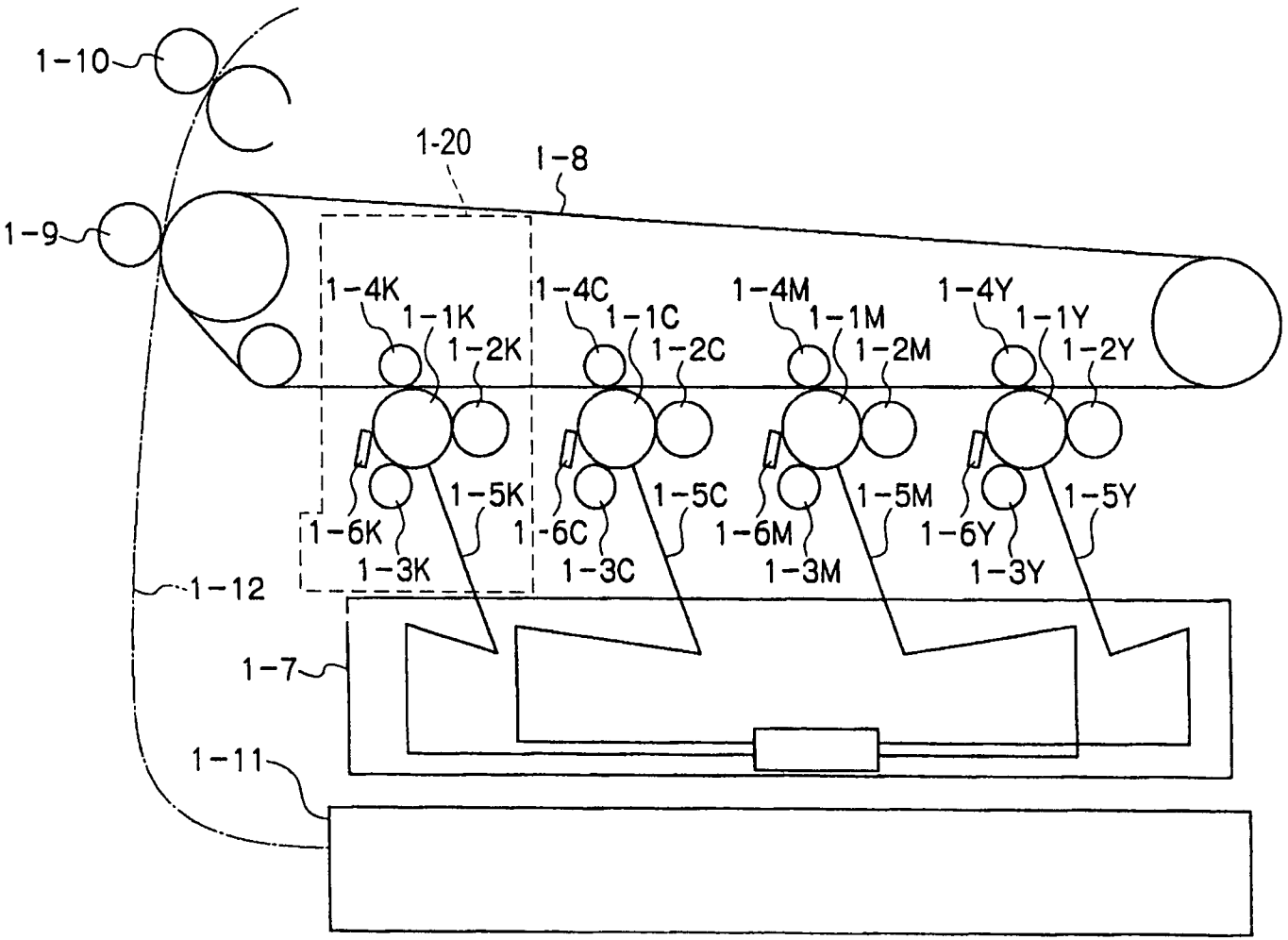
FIG. 1 is a schematic constitutional diagram illustrating an embodiment of the image forming apparatus of the invention.

FIG. 1 is a schematic constitutional diagram illustrating an embodiment of the image forming apparatus of the invention. The image forming apparatus shown in FIG. 1 is a so-called tandem-type digital color printer. In the image forming apparatus, respective image forming units for yellow (Y), magenta (M), cyan (C), and black (K) are disposed in parallel. Each image forming unit includes an electrophotographic photoreceptor (occasionally called "photoreceptor" hereinafter). The photoreceptor is held such that the photoreceptor can be rotated in a predetermined direction. The image forming unit further includes a developing unit, a charging roll, a primary transfer roll, an exposure unit, and a cleaning blade disposed along the moving direction of the circumferential surface of the photoreceptor. In the image forming unit, the photoreceptor after charging can be irradiated with the laser light emitted by an ROS (Raster Output Scanner) 1-7 as the exposure unit. For example, the image forming unit for black (K) comprises a photoreceptor 1-1K, a developing unit 1-2K, a charging roll 1-3K, a primary transfer roll 1-4K, and a cleaning blade 1-6K. The photoreceptor 1-1K after charging can be irradiated with an exposure light 1-5K.

It should be noted that the photoreceptor 1-1K, the developing unit 1-2K, the charging roll 1-3K, the primary transfer roll 1-4K and the cleaning blade 1-6K maybe part of the process cartridge 1-20. It should also be noted that the above discussion also applies to photoreceptors 1-1Y, 1-1M, and 1-1C, with developing units 1-2Y, 1-2M and 1-2C, charging rolls 1-3Y, 1-3M and 1-3C, primary transfer rolls 1-4Y, 1-4M and 1-4C, cleaning blades 1-6Y, 1-6M and 1-6C, wherein the photoreceptor 1-1Y, 1-1M and 1-1C after charging can be irradiated with an exposure light 1-5Y, 1-5M and 1-5C, respectively.

Each of the photoreceptors 1-1Y, 1-1M, 1-1C, and 1-1K comprises a conductive support, an undercoat layer, and a photosensitive layer. The undercoat layer and the photosensitive layer are disposed on the conductive support. The undercoat layer includes a metal oxide particle and an acceptor compound having a group capable of reacting with the metal oxide particle. The details of the photoreceptor will be described later.

Each photoreceptor is connected to a driving unit, though the details are not shown in the figures. The driving unit has a controlling function of controlling the rotating velocity (the moving velocity of the circumferential surface) of the photoreceptor. In each image forming unit, the driving unit can change the time required for the processes from charging to development owing to the controlling function. Owing to the controlling function, the image forming unit can switch among a plurality of control modes including a normal mode, a low-speed mode, and a high-speed mode and conduct the image formation in the selected control mode.

For example, in the formation of a black image: the photoreceptor 1-1K is charged by the charging roll 1-3K to which an electric potential is applied; then the photoreceptor 1-1K is imagewise exposed to the laser light 1-5K emitted by the ROS (Raster Output Scanner) 1-7 to form a latent image; then the developing unit 1-2K develops the image with toner; then the toner image is transferred to an intermediate belt 1-8 by the electric field of the primary transfer roll 1-4K; then the toner image is further transferred to a recording medium fed from a paper tray 1-11, by the electric field of the secondary transfer roll 1-9; then the toner image is thermally fixed in a fixing unit 1-10, whereby the recording medium on which the image is formed is discharged.

The color image formation in the normal mode is conducted through the following processes: in the image forming unit for yellow (Y), the photoreceptor 1-1Y is charged by the charging roll 1-3Y to which an electric potential is applied; then the photoreceptor 1-1Y is imagewise exposed to the laser light 1-5Y emitted by the ROS (Raster Output Scanner) 1-7 to form a latent image; then the developing unit 1-2Y develops the image with toner; then the toner image is transferred to an intermediate belt 1-8 by the electric field of the primary transfer roll 1-4Y; then, similar processes are sequentially conducted in the respective image forming units for magenta (M), cyan (C), and black (B), so that a color toner image is formed on the intermediate transfer belt by the multiple transfers; then the toner image is further transferred to a recording medium fed from a paper tray 1-11, by the electric field of the secondary transfer roll 1-9; then the toner image is thermally fixed in a fixing unit 1-10, whereby the recording medium on which the image is formed is discharged. Reference number 1-12 represents a path of paper transfer.

The rotating velocity of the photoreceptor in the normal mode is not particularly restricted. In a preferable embodiment, the rotating velocity is set such that the time required for the processes from charging to development in each image forming unit is 50 msec to 300 msec.

When the recording medium fed from the paper tray is thick paper or an OHP sheet, it is preferable to switch the image formation mode to the low-speed mode. In the low-speed mode, the rotating velocity of the photoreceptor 1-1 in each unit is low, the time required for the processes from charging to development is elongated, and the fixing time is long enough to fix the developer onto the thick paper or the OHP sheet sufficiently. The image formation procedures in the low-speed mode is the same as the procedures in the normal mode described above. The rotating velocity (the moving velocity of the circumferential surface) of the photoreceptor in the low-speed mode is not particularly limited, and preferably satisfies the following formula (1).

$$T_{low} \leq (1/3)T \qquad \text{Formula (1):}$$

(In the formula, T represents the time between charging and development in the electrophotographic process in the normal mode; and $T_{low}$ represents the time between charging and development in the electrophotographic process in the low-speed mode.)

When a monochromatic image (black-and-white image) is printed, the following processes are conducted in the image forming unit for black (K): the photoreceptor 1-1K is charged by the charging roll 1-3K to which an electric potential is applied; then the photoreceptor 1-1K is imagewise exposed to the laser light 1-5K emitted by the ROS (Raster Output Scanner) 1-7 to form a latent image; then the developing unit 1-2K develops the image with toner; then the toner image is transferred to an intermediate belt 1-8 by the electric field of the primary transfer roll 1-4K; then the toner image is further transferred to a recording medium fed from a paper tray 1-11, by the electric field of the secondary transfer roll 1-9; then the toner image is thermally fixed in a fixing unit 1-10, whereby the recording medium on which the image is formed is discharged. In the formation of the monochromatic image, the image formation mode may be switched to the high-speed mode, so that the rotating velocity of the photoreceptor 1-1K is increased and the time required for the processes from charging to development is shortened. The rotating velocity (the moving velocity of the circumferential surface) of the photoreceptor in the high-speed mode is not particularly limited, and preferably satisfies the following formula (2).

$$T_{high} \geqq 3T \qquad \text{Formula (2):}$$

(In the formula, T represents the time between charging and development in the electrophotographic process in the normal mode; and $T_{high}$ represents the time between charging and development in the electrophotographic process in the high-speed mode.)

When the undercoat layers of the photoreceptors 1-1Y, 1-1M, 1-1C, and 1-1K of the tandem-type color image forming apparatus each include a metal oxide particle and an acceptor compound having a group capable of reacting with the metal oxide particle, the electrophotographic characteristic of the photoreceptors are sufficiently heightened and the use condition thereof can be selected from a broader range. Therefore, even when the image formation mode is switched among the normal mode, the high-speed mode, and the low-speed mode (whereby the image formation is conducted with different lengths of time between charging and development), it is possible to sufficiently suppress the occurrence of the fogging and black spots in the obtained image and the occurrence of the image memory.

In the following, the elements of the image recording apparatus of the invention are described.

Figure 2:
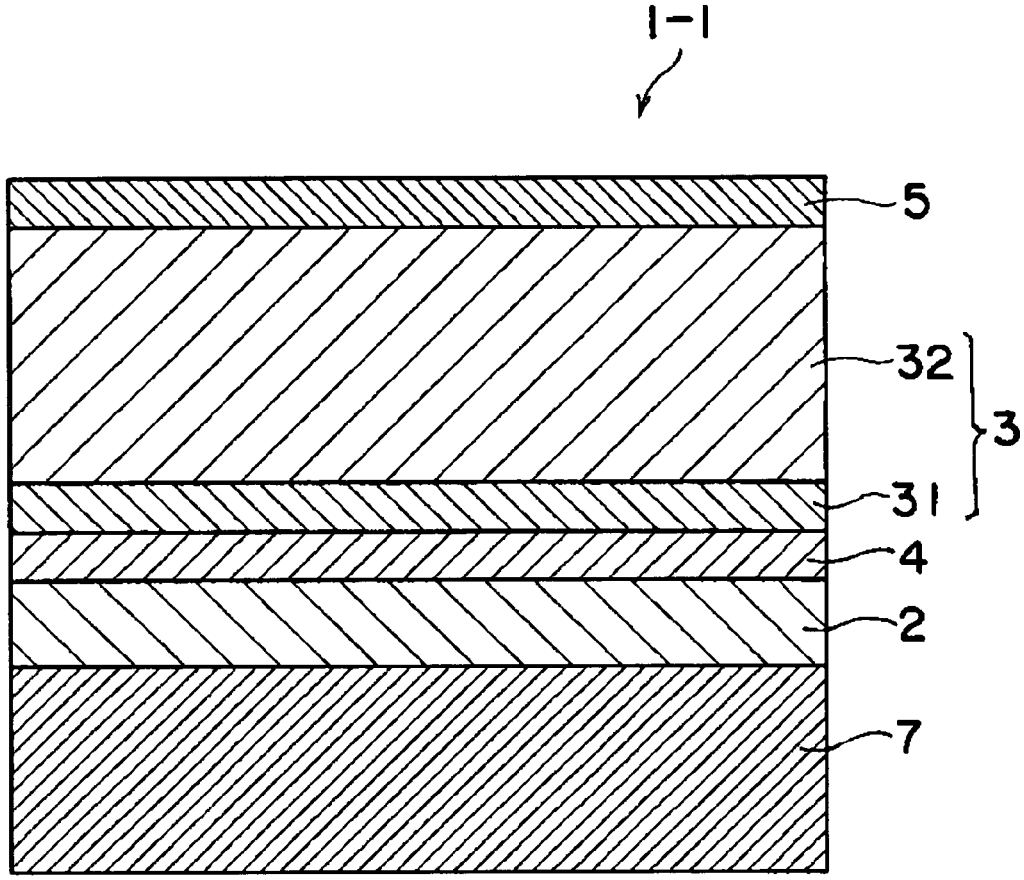
FIG. 2 is a schematic cross-sectional view illustrating an example of the electrophotographic photoreceptor of the invention.

The structure of the photoreceptor is described first. FIG. 2 is a schematic cross-sectional view of an example of the electrophotographic photoreceptor of the image forming apparatus of the invention. An electrophotographic photoreceptor 1-1 has a structure in which an undercoat layer 2, an intermediate layer 4, a photosensitive layer 3, and a overcoat layer 5 are successively laminated on a conductive support 7. The electrophotographic photoreceptor shown in 1-1 is a separated-function photoreceptor; therefore the photosensitive layer 3 is comprised of a charge generating layer 31 and a charge transporting layer 32.

The conductive support 7 may be selected from: metal drums made of metals such as aluminum, copper, iron, stainless-steel, zinc, and nickel; supports obtained by vapor-depositing metals such as aluminum, copper, gold, silver, platinum, palladium, titanium, nickel-chrome, stainless-steel, and indium onto base materials such as sheets, paper, plastics, and glass; supports obtained by vapor-depositing conductive metal compounds such as indium oxide and tin oxide onto base materials such as sheets, paper, plastics, and glass; supports obtained by laminating metal foil on the above base materials; conductive supports obtained by coating the above base materials with coating liquids each prepared by dispersing, in a binder resin, carbon black, indium oxide, tin oxide, antimony oxide powder, metal powder, copper iodide, or the like.

The shape of the conductive support 7 is not limited to a drum shape, but may be, for example, a sheet shape or a plate shape. When the conductive support 7 is a metal pipe, the surface of the metal pipe may be unprocessed, or may be subjected to mirror grinding, etching, anodization, rough grinding, centerless grinding, sandblast, or wet honing.

The undercoat layer 2 includes a metal oxide particle and an acceptor compound having a group capable of reacting with the metal oxide particle.

The metal oxide particle used in the invention has to have a powder resistance of $10^2$ to $10^{11}$ Ω·cm. This is because the undercoat layer must have an appropriate resistance in order to have a leak resistance. The metal oxide particle is preferably a metal oxide particle having a resistance in the above range which particle is selected from a metal titanium oxide particle, a zinc oxide particle, a tin oxide particle, and a zirconium oxide particle. A zinc oxide particle is particularly preferable. When the resistance of the metal oxide particle is lower than the above range, the leak resistance is insufficient. When the resistance of the metal oxide particle is higher than the above range, the residual potential tends to increase. In an embodiment, two or more kinds of metal oxide particles are used each of which is different in particle diameter and/or in the surface treatment to which the kind of metal oxide particle has been subjected. The metal oxide particle has a specific surface of preferably 10 $m^2/g$ or higher. When the specific surface is lower than 10 $m^2/g$, the charging property tends to be insufficient and an excellent electrophotographic characteristic is unlikely to be obtained.

In an embodiment, the metal oxide particle has been subjected to a surface treatment. Any known surface treating agent may be used as long as the surface treating agent can provide the desired properties. For example, the surface treating agent may be selected from a silane coupling agent, a titanate coupling agent, an aluminum coupling agent and a surfactant. In particular, a silane coupling agent is preferable since the silane coupling agent provides a satisfactory electrophotographic characteristic. The silane coupling agent preferably has an amino group since such a silane coupling agent provides an excellent blocking property to the undercoat layer.

The silane coupling agent having an amino group is not particularly limited as long as the resultant electrophotographic photoreceptor has the desired characteristics. Specific examples thereof include (but not limited to) γ-aminopropyltriethoxysilane, N-β-(aminoethyl)-γ-aminopropyl trimethoxysilane, N-β-aminoethyl)-γ-aminopropylmethyl methoxysilane and N,N-bis(β-hydroxyethyl)-γ-aminopropyl triethoxysilane.

In an embodiment, a mixture of two or more silane coupling agents is used. Examples of silane coupling agents that can be used in combination with the silane coupling agent having an amino group include vinyltrimethoxysilane, γ-methacryloxypropyl-tris(β-methoxyethoxy)silane, β-3,4-epoxycyclohexyl)ethyl trimetoxysilane, γ-glycidoxypropyl trimethoxysilane, vinyltriacetoxysilane, γ-mercaptopropyltrimethoxysilane, γ-aminopropyltriethoxysilane, N-β-aminoethyl)-γ-aminopropyl trimethoxysilane, N-β-(aminoethyl)-γ-aminopropylmethyl methoxysilane, N,N-bis(β-hydroxyethyl)-γ-aminopropylmethyl triethoxysilane, and γ-chloropropyltrimethoxysilane; but these examples are not restrictive.

Any known surface treatment method may be employed. The surface treatment method may be a dry method or a wet method.

When the surface treatment method is a dry method, the dry method may comprise: dropwise adding a silane coupling agent as it is or in the form of a solution in an organic solvent to the metal oxide particle while the metal oxide particle is agitated with a mixer or the like having a high shearing force; and spraying the metal oxide coated with the silane coupling agent with dry air or nitrogen gas. This dry method enables a uniform surface treatment. The addition or spraying is preferably conducted at a temperature which is lower than the boiling point of the solvent. When the spraying is conducted at a temperature which is not lower than the boiling point of the solvent, the solvent evaporates before the silane coupling agent is uniformly mixed with the metal particle by the agitation and the silane coupling agent locally aggregate, whereby the surface treatment is unlikely to be uniform. In an embodiment, the metal oxide particle is baked at a temperature of 100° C. or higher after the addition or the spraying. The conditions (such as the temperature and the baking time) of the baking is not particularly limited as long as the resultant photoreceptor has the desired electrophotographic characteristic.

When the surface treatment method is a wet method, the wet method may comprise: dispersing the metal oxide particle in a solvent by agitation, an ultrasonic wave, a sand mill, an attriter or a ball mill; then adding a solution of a silane coupling agent to the metal oxide particle dispersion liquid, dispersing the silane coupling agent and the metal oxide in the mixture liquid by agitation; and removing the solvent. This wet method enables a uniform surface treatment. The removal of the solvent may be conducted by filtration or distillation. In an embodiment, the metal oxide particle is baked at a temperature of 100° C. or higher after the removal of the solvent. The conditions (such as the temperature and the baking time) of the baking is not particularly limited as long as the resultant photoreceptor has the desired electrophotographic characteristic. In the wet method, it is also possible to eliminate the moisture contained in the metal oxide particle prior to the addition of the surface treating agent. The elimination of the moisture may be conducted, for example by: heating the metal oxide particle in the solvent for the surface treatment while agitating the solvent; or utilizing the azeotropy with the solvent.

The amount of the silane coupling agent relative to the metal oxide particles in the undercoat layer may be selected arbitrarily as long as the desired electrophotographic characteristic can be obtained.

The acceptor compound may be any compound having a group capable of reacting with the metal oxide particle as long as the desired characteristics can be obtained. The acceptor compound is preferably a compound having a hydroxyl group. The acceptor compound is more preferably a compound having a hydroxyl group and an anthraquinone structure. The compound having a hydroxyl group and an anthraquinone structure may be a hydroxyanthraquinone compound or an aminohydroxyanthraquinone compound. More specifically, the compound is preferably alizarin, quinizarin, anthrarufin, or purpurin.

The amount of the acceptor compound to be used in the invention is not particularly limited as long as the desired characteristics can be obtained. The amount of the acceptor compound is preferably 0.01 to 20% by weight based on the weight of the metal oxide particles, more preferably 0.05 to 10% by weight based on the weight of the metal oxide particles. When the amount of the acceptor compound is smaller than 0.01% by weight based on the weight of the metal oxide particles, the obtained acceptor property is insufficient for contributing to the improvement of the charge accumulation in the undercoat layer, whereby the durability is likely to be deteriorated; for example, the residual potential tends to increase during repetitive use. When the amount of the acceptor compound is larger than 20% by weight based on the weight of the metal oxide particles, the metal oxide particles aggregate easily and the metal oxide particles fail to form an excellent conductive path in the undercoat layer upon the formation of the undercoat layer, whereby image quality defects such as black spots are likely to occur and the durability is likely to be deteriorated; for example, the residual potential tends to increase during repetitive use.

The binder resin contained in the undercoat layer 2 may be any known resin as long as the resin can form an excellent film and provide the desired characteristics. The binder resin may be a known polymer resin, which may be a charge transporting resin having a charge transporting group or a conductive resin such as polyaniline. Examples of the polymer resin include acetal resins such as polyvinylbutyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins, and urethane resins. The resin is preferably a resin which is insoluble in the solvent used for the application of the upper layer. The resin is more preferably a phenolic resin, a phenol-formaldehyde resin, a melamine resin, an urethane resin or an epoxy resin.

In the coating liquid for forming the undercoat layer 2, the ratio of the metal oxide fine particles to the binder resin is not particularly limited as long as the resultant electrophotographic photoreceptor has the desired characteristics.

The coating liquid for forming the undercoat layer 2 may further include various additives for the purpose of improving the electric characteristics, the environmental stability and the image quality.

Examples of the additives include: electron transporting substances such as quinone compounds (such as chloranil and bromoanil), tetracyanoquinodimethane compounds, fluorenone compounds (such as 2,4,7-trinitrofluorenone and 2,4,5,7-tetranitro-9-fluorenone), oxadiazole compounds (such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole), xanthone compounds, thiophene compounds, and diphenoquinone compounds (such as 3,3',5,5'-tetra-t-butyldiphenoquinone); electron transporting pigments such as condensed polycyclic electron transporting pigments and azo electron transporting pigments; and other known substances such as zirconium chelate compounds, titanium chelate compounds, aluminum chelate compounds, titanium alkoxide compounds, organic titanium compounds, and silane coupling agents.

A silane coupling agent is used for the surface treatment of zinc oxide. In addition, a silane coupling agent may be also included in the coating liquid as an additive. Examples of the silane coupling agent as the additive include vinyltrimethoxysilane, γ-methacryloxypropyl-tris(β-methoxyethoxy)silane, β-(3,4-epoxycyclohexyl)ethyl trimethoxysilane, γ-glycidoxypropyl trimethoxysilane, vinyltriacetoxysilane, γ-mercaptopropyltrimethoxysilane, γ-aminopropyltriethoxysilane, N-β-(aminoethyl)-γ-aminopropyl trimethoxysilane, N-β-(aminoethyl)-γ-aminopropylmethyl methoxysilane, N,N-bis(β-hydroxyethyl)-γ-aminopropyl triethoxysilane, and γ-chloropropyltrimethoxysilane. Examples of the zirconium chelate compounds include zirconium butoxide, zirconium ethyl acetacetate, zirconium triethanolamine, acetylacetonate zirconium butoxide, ethyl acetacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butyrate, diethylacetacetate aluminum diisopropylate, and aluminum tris(ethyl acetacetate).

Only a single kind of such an additive may be used, or a mixture of two or more kinds of such additives may be used, or a polycondensate of two or more kinds of such additives may be used.

The solvent for preparing the coating liquid for the undercoat layer may be arbitrarily selected from known organic solvents such as alcohol solvents, aromatic solvents, halogenated hydrocarbon solvents, ketone solvents, ketone alcohol solvents, ether solvents and ester solvents. Specific examples of the solvent include methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene and toluene.

Only a single solvent may be used or a two or more solvents may be used, for dispersing the components of the undercoat layer to form the coating liquid. When two or more solvents are used, the solvents may be any solvents as long as the mixture of the solvents can dissolve the binder resin.

The method for dispersing the metal oxide particles may be any known method using, for example, a roll mill, a ball mill, a vibrating ball mill, an attriter, a sand mill, a colloid mill, or a paint shaker. The undercoat layer 2 may be applied by a usual method such as a blade coating method, a wire bar coating method, a spray coating method, an immersion coating method, a bead coating method, an air knife coating method or a curtain coating method.

The obtained coating liquid for forming the undercoat layer 2 is applied to the conductive support 7 to form the undercoat layer 2 on the conductive support 7.

The undercoat layer 2 has a Vickers strength of preferably 35 or higher. The undercoat layer 2 has a thickness of preferably 15 μm or larger, more preferably 20 to 50 μm.

When the thickness of the undercoat layer 2 is smaller than 15 μm, a sufficient leak resistance cannot be obtained. On the other hand, when the thickness of the undercoat layer 2 is larger than 50 μm, the residual potential tends to increase during longtime use, whereby image density defect is likely to occur.

The surface roughness of the undercoat layer 2 is adjusted to ¼ nλ to ½ nλ for the purpose of preventing moiré patterns, wherein n represents the refractive index of the upper layer and λ represents the wavelength of the laser used for the exposure. In order to adjust the surface roughness, particles such as resin particles may be incorporated into the undercoat layer 2. The resin particles may be, for example, silicone resin particles or crosslinked PMMA resin particles.

The undercoat layer 2 may be polished for the purpose of adjusting the surface roughness. The polishing method may use a buff polishing, a sand blasting, a wet honing or a grinding process.

An intermediate layer 4 may be provided between the undercoat layer 2 and the photosensitive layer 3, for the purpose of improving the electric characteristics, the image quality, the image quality durability, and the adhesion of the photosensitive layer.

The intermediate layer 4 may be comprised of substances which may be selected from polymer resin compounds and organometallic compounds. Examples of the polymer resin compounds include acetal resins such as polyvinylbutyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins. Examples of the organometallic compounds include organometallic compounds containing zirconium, titanium, aluminum, manganese, and silicon atom.

The material constituting the intermediate layer 4 may be a single compound, or a mixture of two or more compounds, or a polycondensate of two or more compounds. An organometallic compound containing zirconium or silicon is preferable since the resultant photoreceptor has a low residual potential, the potential of the resultant photoreceptor is hardly affected by the environment, and the potential of the resultant photoreceptor scarcely change during repetitive use.

Examples of the silicon compound include vinyltrimethoxysilane, γ-methacryloxypropyl-tris(β-methoxyethoxy)silane, β-(3,4-epoxycyclohexyl)ethyl trimethoxysilane, γ-glycidoxypropyl trimethoxysilane, vinyltriacetoxysilane, γ-mercaptopropyltrimethoxysilane, γ-aminopropyltriethoxysilane, N-β-(aminoethyl)-γ-aminopropyl trimethoxysilane, N-β-aminoethyl)-γ-aminopropylmethyl methoxysilane, N,N-bis(β-hydroxyethyl)-γ-aminopropyl triethoxysilane, and γ-chloropropyltrimethoxysilane. Among these, the following silicon compounds, which are silane coupling agents, are preferable: vinyltriethoxysilane, vinyltris(2-methoxyethoxysilane), 3-methacryloxypropyl trimethoxysilane, 3-glycidoxypropyl trimethoxysilane, 2-3,4-epoxycyclohexyl)ethyl trimethoxysilane, N-2-aminoethyl)-3-aminopropyl trimethoxysilane, N-2-(aminoethyl)-3-aminopropylmethyl dimethoxysilane, 3-aminopropyltriethoxysilane, N-phenyl-3-aminopropyltrimethoxysilane, 3-mercaptopropyl trimethoxysilane and 3-chloropropyltrimethoxysilane.

Examples of the organic zirconium compounds include zirconium butoxide, zirconium ethyl acetacetate, zirconium triethanolamine, acetylacetonate zirconium butoxide, ethyl acetacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide.

Examples of the organic titanium compounds include tetraisopropyl titanate, tetra-n-butyl titanate, butyl titanate dimer, tetra(2-ethylhexyl)titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxytitanium stearate.

Examples of the organic aluminum compounds include aluminum isopropylate, monobutoxyaluminum diisopropylate, aluminum butyrate, diethylacetacetate aluminum diisopropylate, and aluminum tris(ethyl acetacetate).

The intermediate layer 4 improves the coatability of the upper layer. In addition, the intermediate layer 4 functions as an electrical blocking layer. However, when the thickness of the intermediate layer 4 is excessively large, the electric barrier is excessively high, thus causing desensitization and/or an increase in electric potential during repetitive use. Therefore, when the intermediate layer 4 is provided, the thickness of the intermediate layer 4 is preferably 0.1 to 5 μm.

The charge generating layer 31 in the photosensitive layer 3 is formed by a vacuum deposition of a charge generation substance, or by dispersing a charge generating substance and a binder resin in an organic solvent to form a coating solvent and applying the solvent.

When the charge generating layer 31 is formed by the dispersing and coating, the charge generating layer 31 may be formed by: dispersing a charge generation substance, a binder resin, and additives in an organic solvent, and applying thus obtained dispersion liquid.

In the present invention, the charge generating substance may be any known charge generating substance. The charge generating substance may be a phthalocyanine pigment, squalirium, bisazo, trisazo, perylene, or dithioketopyrrolopyrrole when the light used for the exposure is an infrared light. The charge generating substance may be a condensed polycyclic pigment, bisazo, perylene, trigonal selenium, or a colorant-sensitized zinc oxide particle when the light used for the exposure is a visible light. The charge generating substance is preferably a phthalocyanine pigment or an azo pigment since such a pigment can provide particularly excellent performance. Use of a phthalocyanine pigment enables an electrophotographic photoreceptor 1-1 to have a particularly high sensitivity and excellent stability in repetitive use.

Phthalocyanine pigments or azo pigments usually have several crystalline forms, any of which may be used in the invention as long as a suitable sensitivity for the purpose can be obtained. Examples of preferable phthalocyanine pigments include chlorogallium phthalocyanine, dichlorotin phthalocyanine, hydroxygallium phthalocyanine, metal-free phthalocyanine, oxytitanyl phthalocyanine and chloroindium phthalocyanine.

The phthalocyanine pigment crystals may be prepared by mechanically dry crushing a phthalocyanine pigment prepared by a known process with an automatic mortar, a planet mill, a vibrating mill, a CF mill, a roller mill, a sand mill, a kneader, or the like. After the dry mechanical crushing, the phthalocyanine pigment may be wet crushed with a solvent, using a ball mill, a mortar, a sand mill, a kneader, or the like.

The solvent to be used in the aforementioned wet crushing may be an aromatic solvent (such as toluene or chlorobenzene), an amide (such as dimethylformamide or N-methylpyrrolidone), an aliphatic alcohol (such as methanol, ethanol, or butanol), an aliphatic polyhydric alcohol (such as ethylene glycol, glycerin, or polyethylene glycol), an aromatic alcohol (such as benzyl alcohol or phenethyl alcohol), an ester (an acetate ester such as butyl acetate), a ketone (such as acetone or methyl ethyl ketone), dimethylsulfoxide, an ether (such as diethyl ether or tetrahydrofuran), a mixture of two or more solvents selected from the above solvents, or a mixture of water and organic solvents selected from the aforementioned organic solvents.

The amount of the solvent to be used is within the range of 1 to 200% by weight, preferably 10 to 100% by weight, with respect to 1 part by weight of the pigment crystals. The process temperature at the wet crushing is within the range of from −20° C. to the boiling temperature of the solvent, preferably −10° C. to 60° C. At the crushing, an auxiliary crushing agent such as common salt or Glauber's salt may be used in addition. The weight of the auxiliary crushing agent to be used may be 0.5 to 20 times the weight of the pigment, preferably 1 to 10 times the weight of the pigment.

The formation of the phthalocyanine pigment crystals from a known phthalocyanine pigment may be conducted by an acid pasting or an acid pasting combined with a dry or wet crushing as mentioned above. The acid used in the acid pasting is preferably sulfuric acid whose concentration is 70 to 100%, preferably 95 to 100%. The dissolution temperature is adjusted to a temperature within the range of −20 to 100° C., preferably −10 to 60° C. The weight of the concentrated sulfuric acid is 1 to 100 times the weight of the phthalocyanine pigment crystals, preferably 3 to 50 times the weight of the phthalocyanine pigment crystals. The solvent used for the crystallization may be an arbitrary amount of water or an arbitrary amount of a mixture of water and an organic solvent. The crystallization temperature is not particularly restricted, but a cooling with ice or the like is preferable in order to avoid heat generation.

The hydroxygallium phthalocyanine is particularly preferably a phthalocyanine having diffraction peaks at Bragg angles (2θ±0.2°) of 7.5°, 9.9°, 12.5°, 16.3°, 18.6°, 25.1°, and 28.3° with respect to the CuKα characteristic X rays. In the preparation of the hydroxygallium phthalocyanine of the invention, the type I hydroxygallium phthalocyanine as the starting substance may be prepared by a known method. An example of the method is described below.

A crude gallium phthalocyanine is prepared by a method such as: a type I chlorogallium phthalocyanine method comprising allowing gallium trichloride to react with o-phthalodinitril or 1,3-diiminoisoindoline in a predetermined solvent; or a phthalocyanine dimer method comprising heating o-phthalodinitril, alkoxygallium, and ethyleneglycol in a predetermined solvent, thus allowing them to react with each other to form a phthalocyanine dimer. The solvents to be used in the above reactions may be selected from inactive solvents having high boiling points whose examples include α-chloronaphthalene, β-chloronaphthalene, α-methylnaphthalene, methoxynaphthalene, dimethylaminoethanol, diphenylethane, ethyleneglycol, dialkylether, quinoline, sulfolane, dichlorobenzene, dimethylformamide, dimethylsulfoxide, and dimethylsulfoamide.

In the exemplary method, the crude gallium phthalocyanine prepared above is subjected to an acid pasting treatment, so that the crude gallium phthalocyanine is atomized and converted to a type I hydroxygallium phthalocyanine pigment. The acid pasting treatment may comprise: dissolving the crude gallium phthalocyanine in an acid such as sulfuric acid, or making a salt between the crude gallium phthalocyanine and an acid such as sulfuric acid; pouring the solution or the salt into water or ice-cold water so as to recrystallize the gallium phthalocyanine. The acid used for the acid pasting treatment is preferably sulfuric acid whose concentration is preferably 70% to 100%, more preferably 95% to 100%.

In the exemplary method, the hydroxygallium phthalocyanine is obtained by crystal conversion of the obtained type I hydroxygallium phthalocyanine pigment. The crystal conversion is conducted by wet crushing the type I hydroxygallium phthalocyanine pigment in a solvent. In the preparation of the hydroxygallium phthalocyanine of the invention, it is preferable to use a crushing machine which uses spherical media having a diameter of 0.1 to 3.0 mm, more preferably 0.2 to 2.5 mm. When the diameter of the media is larger than 3.0 mm, the crushing efficiency is lowered and the diameter of the obtained particles is not sufficiently small, thus easily forming aggregates. When the diameter of the media is smaller than 0.1 mm, it is difficult to separate the media and the hydroxygallium phthalocyanine. When the shape of the media is a shape (such as cylindrical or amorphous) other than spherical shape, the crushing efficiency is decreased and media are easily worn by the crushing, whereby the wear debris as an impurity deteriorates the characteristics of the hydroxygallium phthalocyanine.

The material for the media is not particularly limited. The material is preferably such a material as not to cause image quality defects when the pigment is contaminated with the material. The material is preferably selected from glass, zirconia, alumina, and agate.

The material of the container is not particularly limited either. The material is preferably a material such as not to cause image quality defects when the pigment is contaminated with the material. The material of the container is preferably glass, zirconia, alumina, agate, polypropylene, TEFLON, or polyphenylene sulfide. It is also preferable to use a metal container whose internal surface is coated with glass, polypropylene, TEFLON, polyphenylene sulfide, or the like, and the metal container may be made of iron, stainless steel, or the like.

The amount of the media to be used depends on the crushing machine to be used. The amount of the media is preferably at least 50 parts by weight per 1 part by weight of type I hydroxygallium phthalocyanine, more preferably 55 parts by weight to 100 parts by weight per 1 part by weight of type I hydroxygallium phthalocyanine. As the diameter of the media decreases, the viscosity of the liquid containing the pigment and the media increases to change the crushing efficiency, provided that the amount of the media is constant. Accordingly, when the diameter of the media is decreased, it is preferable to select the optimal mixing ratio of the media and the solvent at the wet crushing by adjusting the amount of the media and the amount of the solvent.

The wet crushing is conducted within the temperature range of 0 to 100° C., preferably 5 to 80° C., more preferably 10 to 50° C. When the temperature is low, the crystal transfer rate is low. When the temperature is too high, the solubility of the hydroxygallium phthalocyanine increases to cause excessive crystal formation, thus making it hard to atomize the crystal.

The solvent used in the wet crushing treatment is preferably selected from: amides such as N,N-dimethylformamide, N,N-dimethylacetoamide, and N-methylpyrrolidone; esters such as ethyl acetate, n-butyl acetate, and iso-amyl acetate; ketones such as acetone, methylethylketone, and methyl isobutyl ketone; and dimethyl sulfoxide. The amount of the solvent to be used is preferably 1 to 200 parts by weight per 1 part by weight of the hydroxygallium phthalocyanine pigment, more preferably 1 to 100 parts by weight per 1 part by weight of the hydroxygallium phthalocyanine pigment.

The machine used for the wet crushing treatment may be a machine which use media as a dispersing medium. Examples thereof include vibrating mills, automatic morters, sand mills, dyno-mills, coball mills, attritors, planet ball mills, and ball mills.

The proceeding speed of the crystal conversion is largely affected by the scale of the wet crushing treatment, the stirring speed, the media material, or the like. The crystal conversion is monitored by measuring the absorption wavelengths of the liquid subjected to the wet crushing. The crystal conversion is allowed to proceed until the hydroxygallium phthalocyanine of the invention is obtained. The crystal conversion to the hydroxygallium phthalocyanine of the invention is confirmed by the absorption spectrum of the liquid, and the crystal conversion is allowed to proceed until the absorption peak wavelength in the wavelength range of 600 to 900 nm falls within the wavelength range of 810 to 839 nm. The wet crushing is conducted generally for 5 hours to 500 hours, preferably 7 hours to 300 hours. When the wet crushing treatment time is shorter than 5 hours, the crystal conversion is unlikely to be completed, thus often deteriorating the electrophotographic characteristics and causing insufficient sensitivity. When the wet crushing treatment time is longer than 500 hours, the crushing stress sometimes causes reduction in the sensitivity, and reduction in the productivity and incorporation of the wear debris of the media are likely to occur. When the wet crushing treatment time is within the above range, the wet crushing treatment can provide uniformly atomized hydroxygallium phthalocyanine particles.

The binder resin in the charge generating layer 31 may be selected from various insulating resins. The binder resin may be an organic photoconductive polymer such as poly-N-vinylcarbazole, polyvinylanthracene, polyvinylpyrene or polysilane. Examples of preferable insulating binder resins include polyvinylacetal resins, polyarylate resin (such as a polycondensate of bisphenol-A and phthalic acid), polycarbonate resins, polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, casein, polyvinyl alcohol resins, and polyvinylpyrrolidone resins, but these examples are not restrictive. Only a single binder resin may be used or two or more binder resins may be used. Polyvinylacetal resins are more preferable.

In the coating liquid for forming the charge generating layer, the mixing ratio (weight ratio) of the charge generating substance and the binder resin is preferably within the range of 10:1 to 1:10. The solvent used for the preparation of the coating liquid may be an arbitrarily selected from known organic solvents. Examples thereof include alcohol solvents, aromatic solvents, halogenated hydrocarbon solvents, ketone solvents, ketone alcohol solvents, ether solvents and ester solvents. Specific examples of the solvent include methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene and toluene.

Only a single solvent may be used or a two or more solvents may be used, for dispersing the components of the charge generating layer to form the coating liquid. When two or more solvents are used, the solvents may be any solvents as long as the mixture of the solvents can dissolve the binder resin.

The method for dispersing the components of the charge generating layer may be a roll mill, a ball mill, a vibrating ball mill, an attriter, a sand mill, a colloid mill, or a paint shaker. The charge generating layer may be applied by a usual method such as a blade coating method, a wire bar coating method, a spray coating method, an immersion coating method, a bead coating method, an air knife coating method or a curtain coating method.

At the dispersion, it is preferable to adjust a particle size to 0.5 μm or smaller, preferably 0.3 μm or smaller and more preferably 0.15 μm or smaller since such a particle size is effective for attaining high sensitivity and high stability.

Also the charge generation substance may be subjected to a surface treatment for the purpose of improving the stability of the electric characteristics and preventing the image quality defects. The surface treatment improves the dispersibility of the charge generating substance and coatability of the coating liquid for forming the charge generating layer, thereby assuring easy formation of a smooth charge generating layer 31 having a uniform dispersion state. As a result, image quality defects such as fogging and ghost are prevented and the image storability is improved. Since the storability of the coating liquid for forming the charge generating layer is also improved remarkably, the pot life is effectively elongated by the surface treatment, thereby enabling the reduction of the cost of the photoreceptor.

The surface treatment agent may be an organometallic compound having a hydrolyzable group or a silane coupling agent.

The organometallic compound having a hydrolyzable group or the silane coupling agent may be a compound represented by the following formula (A):

$$Rp\text{-}MYq \qquad \text{Formula (A)}$$

In the formula (A): R represents an organic group; M represents a metal atom other than alkaline metals or represents a silicon atom; Y represents a hydrolyzable group, p and q each independently represents an integer of 1 to 4; and the sum of p and q corresponds to the valence of M.

Examples of the organic group represented by R in the formula (A) include: alkyl groups such as methyl group, ethyl group, propyl group, butyl group, and octyl group; alkenyl groups such as vinyl group and allyl group; cycloalkyl groups such as cyclohexyl group; aryl groups such as phenyl group and naphthyl group; alkaryl groups such as tolyl group; arylalkyl groups such as benzyl group and phenylethyl group; arylalkenyl groups such as styryl group; and heterocyclic groups such as furyl group, thienyl group, pyrrolidinyl group, pyridyl group, and imidazolyl group. These organic groups each may have one substituent, or two or more substituents which may be of the same kind or of different kinds.

Examples of the hydrolyzable group represented by Y in the formula (A) include: ether groups such as methoxy group, ethoxy group, propoxy group, butoxy group, cyclohexyloxy group, phenoxy group, and benzyloxy group; ester groups such as acetoxy group, propionyloxy group, acryloxy group, methacryloxy group, benzoyloxy group, methanesulfonyloxy group, benzensulfonyloxy group, and benzyloxycarbonyl group; and halogen atoms such as chlorine atom.

In the formula (A), M may be any atom other than alkaline metal atoms. The atom represented by M is preferably a titanium atom, an aluminum atom, a zironium atom, or a silicon atom. In other words, in the present invention, the surface treatment agent is preferably selected from organic titanium compounds, organic aluminum compounds, organic zirconium compounds, and silane coupling agents each of which has an organic group and a hydrolyzable functional group as explained above.

Examples of the silane coupling agent include vinyltrimethoxysilane, γ-methacryloxypropyl-tris(β-methoethoxy) silane, β-3,4-epoxycylohexyl)ethyl trimetoxysilane, γ-glycidoxypropyl trimethoxysilane, vinyltriacetoxysilane, γ-mercaptopropyltrimethoxysilane, γ-aminopropyltriethoxysilane, N-β-(aminoethyl)-γ-aminopropyl trimethoxysilane, N-β-(aminoethyl)-γ-aminopropylmethyl methoxysilane, N,N-bis(β-hydroxyethyl)-γ-aminopropyl triethoxysilane, or γ-chloropropyltrimethoxysilane.

The silane coupling agent is preferably selected from vinyltriethoxysilane, vinyltris(2-methoxyethoxysilane), 3-methacryloxypropyl trimethoxysilane, 3-glycidoxypropyl trimethoxysilane, 2-(3,4-epoxycyclohexyl)ethyl trimethoxysilane, N-2-aminoethyl)-3-aminopropyl trimethoxysilane, N-2-aminoethyl)-3-aminopropylmethyl dimethoxysilane, 3-aminopropyltriethoxysilane, N-phenyl-3-aminopropyltrimethoxysilane, 3-mercaptopropyl trimethoxysilane and 3-chloropropyltrimethoxysilane.

The surface treatment agent may be an organic zirconium compound. Examples thereof include zirconium butoxide, zirconium ethyl acetacetate, zirconium triethanolamine, acetylacetonate zirconium butoxide, ethyl acetacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide.

The surface treatment agent may be an organic titanium compound. Examples thereof include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxytitanium stearate. The surface treatment agent may be an organic aluminum compound. Examples thereof include aluminum isopropylate, monobutoxyaluminum diisopropylate, aluminum butyrate, diethylacetacetate aluminum diisopropylate, and aluminum tris(ethyl acetacetate).

The surface treatment agent may be a hydrolysate of any of the above organometallic compounds and silane coupling agents. The hydrolysate may be formed by hydrolysis of an organometallic compound represented by the formula (A); specifically, Y (a hydrolyzable group) or a hydrolyzable group on R (an organic group) may be hydrolyzed to form the hydrolysate, Y and R being bound to M (a silicon atom or a metal atom other than alkaline metal atoms). When an organometallic compound or a silane coupling agent has two or more hydrolyzable group, the hydrolysate is not necessarily a hydrolysate obtained by complete hydrolysis of all the hydrolyzable groups, and may be a hydrolysate obtained by hydrolysis of some of the hydrolyzable groups. Only one of the organometallic compounds and the silane coupling agents may be used, or a mixture of two or more surface treatment agents selected from the organometallic compounds and the silane coupling agents may be used.

Regarding the method for coating the phthalocyanine pigment with the organometallic compound and/or the silane coupling agent having a hydrolyzable group (hereinafter simply called "organometallic compound") may be selected from the following exemplary methods: a method comprising coating the phthalocyanine pigment with the organometallic compound in the process of the adjustment of the phthalocyanine pigment crystal; a method comprising coating the phthalocyanine pigment with the organometallic compound before the phthalocyanine pigment is dispersed in the binder resin; a method comprising adding the organometallic compound when the phthalocyanine pigment is dispersed in the binder resin; and a method comprising adding the organometallic compound after the phthalocyanine pigment is dispersed in the binder resin and further dispersing the substances in the mixture.

When the phthalocyanine pigment is coated with the organometallic compound in the process of the adjustment of the phthalocyanine pigment crystal, the following exemplary examples may be used: a method comprising mixing the organometallic compound and the phthalocyanine pigment whose crystal form has not been adjusted, and heating the mixture; a method comprising mixing the organometallic compound and the phthalocyanine pigment whose crystal form has not been adjusted, and mechanically dry crushing the mixture; and a method comprising adding whose crystal form has not been adjusted, and wet crushing the mixture.

If the phthalocyanine pigment is coated with the organometallic compound before the phthalocyanine compound is dispersed in the binder resin, the following exemplary method may be used: a method comprising mixing the phthalocyanine pigment, the organometallic compound, and water or a mixed solvent of water and an organic solvent, and heating the mixture; a method comprising spraying the organometallic compound to the phthalocyanine pigment; and a method comprising mixing the organometallic compound and the phthalocyanine pigment and milling the mixture.

When the organometallic compound is added when the phthalocyanine pigment is dispersed, the following exemplary methods may be used: a method comprising sequentially adding the organometallic compound, the phthalocyanine pigment, and the binder resin to a dispersing solvent while stirring the dispersing solvent; and a method comprising adding such components of the charge generating layer to a dispersing solvent at one time, and mixing them.

The coating liquid for forming the charge generating layer may further include various additives for the purposes of improving the electric characteristics and the image quality. The additives may be an electron transporting substance, an electron transporting pigment such as a condensed polycyclic electron transporting pigment or a azo electron transporting pigment, or another known material such as a zirconium chelate compound, a titanium chelate compound, an aluminum chelate compound, a titanium alkoxide compound, an organic titanium compound or a silane coupling agent. Examples of the electron transporting substance include: a quinone compound such as chloranil, bromoanil and anthraquinone; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds, thiophene compounds, and diphenoquinone compounds such as 3,3',5,5'-tetra-t-butyldiphenoquinone.

Examples of the silane coupling agent include vinyltrimethoxysilane, γ-methacryloxypropyl-tris(β-methoxyethoxy)silane, β-3,4-epoxycyclohexyl)ethyl trimethoxysilane, γ-glycidoxypropyl trimethoxysilane, vinyltriacetoxysilane, γ-mercaptopropyltrimethoxysilane, γ-aminopropyltriethoxysilane, N-γ-(aminoethyl)-γ-aminopropyl trimethoxysilane, N-β-(aminoethyl)-γ-aminopropylmethyl methoxysilane, N,N-bis(β-hydroxyethyl)-γ-aminopropyl triethoxysilane, and γ-chloropropyltrimethoxysilane.

Examples of the zirconium chelate compound include zirconium butoxide, ethyl zirconium acetacetate, zirconium triethanolamine, acetylacetonate zirconium butoxide, ethyl acetacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide.

Examples of the titanium chelate compound include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxytitanium stearate.

Examples of the aluminum chelate compound include aluminum isopropylate, monobutoxyaluminum diisopropylate, aluminum butyrate, diethylacetacetate aluminum diisopropylate, and aluminum tris(ethyl acetacetate).

Only a single compound selected from the above compounds may be used, or a mixture of two or more compounds selected from the above compounds may be used, or a polycondensate of two or more compounds selected from the above compounds may be used.

The charge generating layer 31 may be formed by an ordinary coating method such as a blade coating method, a wire bar coating method, a spray coating method, an immersion coating method, a bead coating method, an air knife coating method or a curtain coating method.

The coating liquid may include a small amount of a silicone oil as a leveling agent which improves the smoothness of the coated film. The thickness of the charge generating layer 31 is preferably 0.05 to 5 μm, more preferably 0.1 to 2.0 μm.

The charge transporting layer 32 may be prepared by a known method. The charge transporting layer 32 may comprise a charge transporting substance and a binder resin, or may comprise a polymer charge transporting substance.

The charge transporting substance contained in the charge transporting layer 32 may be any known charge transporting substance. The charge transporting substance may be a positive hole transporting substance, an electron transporting substance, or a polymer having, on its main chain or on its side chain, a group derived from the following positive hole transporting substances and electron transporting substances. Examples of the positive hole transporting substance include: oxadiazole derivatives such as 2,5-bis(p-diethylaminophenyl)-1,3,4-oxadiazole; pyrazoline derivatives such as 1,3,5-triphenyl-pyrazoline and 1-[pyridyl-(2)]-3-(p-diethylaminostyryl)-5-(p-diethylaminostyryl)pyrazoline; aromatic tertiary amino compounds such as triphenylamine, tri(p-methyl)phenylamine, N,N'-bis(3,4-dimethylphenyl)biphenyl-4-amine, dibenzylaniline, and 9,9-dimethyl-N,N'-di(p-tolyl) fluorenone-2-amine; aromatic tertiary diamino compounds such as N,N'-diphenyl-N,N'-bis(3-methylphenyl)-[1,1-biphenyl]-4,4'-diamine; 1,2,4-triazine derivatives such as 3-4'-dimethylaminophenyl)-5,6-di-4'-methoxyphenyl)-1,2,4-triazine; hydrazone derivatives such as 4-diethylaminobenzaldehyde-1,1-diphenylhydrazone, 4-diphenylaminobenzaldehyde-1,1-diphenylhydrazone, and [p-(diethylamino)phenyl](1-naphthyl)phenylhydrazone; quinazoline derivatives such as 2-phenyl-4-styryl-quinazoline; benzofuran derivatives such as 6-hydroxy-2,3-di(p-methoxyphenyl)-benzofuran; α-stilbene derivatives such as p-(2,2-diphenylvinyl)-N,N'-diphenylaniline; enamin derivatives; carbazole derivatives such as N-ethylcarbazole; and poly-N-vinylcarbazole and derivatives thereof. Examples of the electron transporting substance include: quinone compounds such as chloranil, bromoanil and anthraquinone; tetracyanoquinodimethane compounds, fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds, thiophene compounds, and diphenoquinone compounds such as 3,3',5,5'-tetra-t-butyldiphenoquinone. Only a single charge transporting substance may be used, or two or more charge transporting substances may be used.

The charge transporting substance is preferably selected from compounds each represented by the following structural formula (B-1), (B-2), or (B-3) from the viewpoint of the mobility.

(B-1)

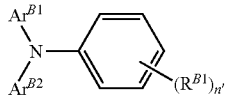

In the formula (B-1), $R^{B1}$ represents a methyl group; n' represents an integer of 0 to 2; $Ar^{B1}$ and $Ar^{B2}$ each independently represent an aryl group which may have a substituent, the substituent being selected from a halogen atom, an alkyl group having 1 to 5 carbon atoms, an alkoxy group having 1 to 5 carbon atoms or a amino group substituted by an alkyl group having 1 to 3 carbon atoms.

(B-2)

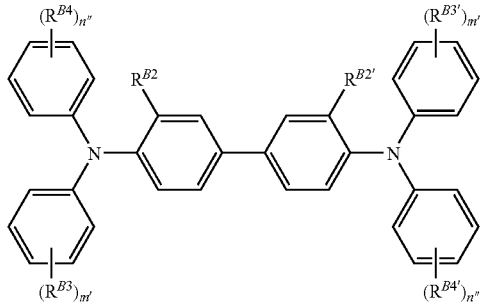

In the formula (B-2), $R^{B2}$ and $R^{B2'}$ may be the same as each other or different from each other, and each independently represent a hydrogen atom, a halogen atom, an alkyl group having 1 to 5 carbon atoms, or an alkoxy group having 1 to 5 carbon atoms; any two of $R^{B3}$, $R^{B3'}$, $R^{B4}$ and $R^{B4'}$ may be the same as each other or different from each other, and each independently represent a hydrogen atom, a halogen atom, an alkyl group having 1 to 5 carbon atoms, an alkoxy group having 1 to 5 carbon atoms, an amino group substituted by an alkyl group having 1 to 2 carbon atoms, a substituted or non-substituted aryl group, or —C($R^{B5}$)═C($R^{B6}$)($R^{B7}$), wherein $R^{B5}$, $R^{B6}$ and $R^{B7}$ each independently represent a hydrogen atom, a substituted or non-substituted alkyl group or a substituted or non-substituted aryl group; and m' and n" each independently represent an integer of 0 to 2.

In the formula (B-3), $R^{B8}$ represents a hydrogen atom, an alkyl group having 1 to 5 carbon atoms, an alkoxy group having 1 to 5 carbon atoms, a substituted or non-substituted aryl group, or —CH═CH—CH═C($Ar^{B3}$)$_2$, wherein $Ar^{B3}$ represents a substituted or non-substituted aryl group; $R^{B9}$ and $R^{B10}$ may be the same as each other or different from each other, and each independently represent a hydrogen atom, a halogen atom, an alkyl group having 1 to 5 carbon atoms, an alkoxy group having 1 to 5 carbon atoms, an amino group substituted by an alkyl group having 1 to 2 carbon atoms as a substituent, or a substituted or non-substituted aryl group.

The binder resin of the charge transporting layer 32 may be any known binder resin. The binder resin is preferably a resin capable of forming an electrically insulating film.

Examples of the binder resin include insulating resins such as polycarbonate resins, polyester resins, polyarylate resins, methacrylic resins, acrylic resins, polyvinyl chloride resins, polyvinylidene chloride resins, polystyrene resins, acrylonitrile-styrene copolymers, acrylonitrilebutadiene copolymers, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-carbazole, polyvinylbutyral, polyvinylformal, polysulfon, casein, gelatin, polyvinyl alcohol, ethyl cellulose, phenol resins, polyamide, polyacrylamide, carboxymethyl cellulose, vinylidene chloride polymer wax, and polyurethane; polymer charge transporting substances such as polyvinylcarbazole, polyvinylanthracene, polyvinylpyrene, polysilane; and polyester polymer charge transporting substances disclosed in JP-A Nos. 8-176293 and 8-208820, the disclosures of which are incorporated by reference herein. The binder resin is not limited to the above examples and other resin can also be used. Only a single binder resin may be used, or two or more binder resins may be used. The binder resin is preferably a polycarbonate resin, a polyester resin, a methacrylic resin or an acrylic resin in consideration of the compatibility with the charge transporting substance, the solubility in the solvent and the strength. The mixing ratio by weight of the binder resin to the charge transporting substance is not particularly limited, however, the mixing ratio should be selected so as not to cause deterioration of the electric characteristics or decrease in the film strength.

In an embodiment, the charge transporting layer 32 is comprised only of a polymer charge transporting substance. The (B-3)

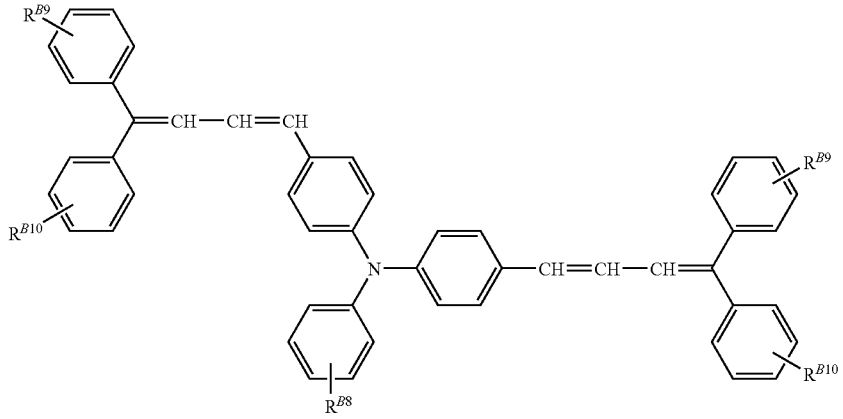

polymer charge transporting substance may be any known substance having a charge transporting property such as poly-N-vinylcarbazole or polysilane. The polyester polymer charge transporting substances disclosed in JP-A Nos. 8-176293 and 8-208820 (the disclosures of which are incorporated herein by reference) is particularly preferable since the polyester polymer charge transporting substances have high charge transporting properties. The charge transporting layer 32 may be comprised only of the polymer charge transporting substance or may be comprised of a mixture of the polymer charge transporting substance and binder resins selected from the binder resins described above.

When the charge transporting layer 32 is the outermost layer of the electrophotographic photoreceptor 1-1 (in other words, when the charge transporting layer 32 is the furthest layer from the conductive support 7), the charge transporting layer 32 preferably includes lubricative particles (such as silica particles, alumina particles, fluorinated resin particles such as polytetrafluoroethylene (PTFE) particles, and silicone resin particles) which provide lubricating property thereby suppressing abrasion of the outermost layer, avoiding flaws on the outermost layer, and enabling easier removal of the developer from the surface of the photoreceptor. The charge transporting layer may include only a single kind of lubricative particles or may include two or more kinds of lubricative particles. The lubricative particles are preferably fluorine-containing resin particles.

The material of the fluorine-containing resin particles is preferably comprised of a resin or two or more resins selected from tetrafluoroethylene resin, trifluoroethylene chloride resin, hexafluoropropylene resin, vinyl fluoride resin, vinylidene fluoride resin, difluorodichloroethylene resin and copolymers thereof. Tetrafluoroethylene resin and vinylidene fluoride resin are particularly preferable.

The fluorine-containing resin has a primary particle size of preferably 0.05 to 1 μm, more preferably 0.1 to 0.5 μm. When the primary particle size is smaller than 0.05 μm, aggregation easily occurs during the dispersing or after the dispersing. When the primary particle size is larger than 1 μm, image quality defects easily occur.

When the charge transporting layer includes a fluorine-containing resin, the content of the fluorine-containing resin in the charge transporting layer is preferably 0.1 to 40% by weight based on the entire amount of the charge transporting layer, particularly preferably 1 to 30% by weight based on the entire amount of the charge transporting layer. When the content is lower than 1% by weight, the advantages of the inclusion of the dispersed fluorine-containing resin particles are not remarkable. When the content is larger than 40% by weight, the light transmittance lowers and the residual potential increases during repetitive use.

The charge transporting layer 32 may be prepared by: dissolving the charge transporting substance, the binder resin, and other substances in a suitable solvent to form a coating liquid for forming the charge transporting layer, and then coating and drying the coating liquid for forming the charge transporting layer.

The solvent to be used for forming the charge transporting layer 32 may be selected from: aromatic hydrocarbon solvents such as toluene and chlorobenzene; aliphatic alcohol solvents such as methanol, ethanol and n-butanol; ketone solvents such as acetone, cyclohexanone and 2-butanone; halogenated aliphatic hydrocarbon solvents such as methylene chloride, chloroform and ethylene chloride; cyclic ether solvents and linear ether solvents such as tetrahydrofuran, dioxane, ethylene glycol and diethyl ether; and mixed solvents thereof. The mixing ratio by weight of the charge transporting substance to the binder resin is preferably in the range of 10/1 to 1/5.

In the coating liquid for forming the charge transporting layer, a small amount of a leveling agent such as silicone oil may be added in order to improve the smoothness of the coated film.

The fluorine-containing resin may be dispersed in the charge transporting layer 32, for example with a roll mill, a ball mill, a vibrating ball mill, an attriter, a sand mill, a high-pressure homogenizer, an ultrasonic disperser, a colloid mill, a collision-type medialess disperser or a penetration-type medialess disperser.

In an embodiment, the fluorine-containing resin particles are dispersed in a solution containing the dissolved binder resin, charge transporting substance, and the like, to give the coating liquid for forming the charge transporting layer 32.

In the preparation of the coating liquid for forming the charge transporting layer 32, the temperature of the coating liquid is preferably maintained in the range of 0° C. to 50° C.

The temperature of the coating liquid may be maintained within the range of 0° C. to 50° C. during the preparation of the coating liquid by any of the following methods: a method of cooling the coating liquid with water; a method of cooling the coating liquid with wind; a method of cooling the coating liquid with a coolant; a method of regulating a room temperature in the manufacturing process; a method of warming the coating liquid with warm water; a method of warming the coating liquid with hot air; a method of warming the coating liquid with a heater; a method of making a coating liquid production equipment with a material that scarcely generate heat, a method of making a coating liquid production equipment with a material which easily radiate the heat, and a method of preparing a coating liquid production equipment with a material which stores the heat. An addition of a small amount of an auxiliary dispersant is effective for improving the dispersion stability of the dispersion liquid and for preventing aggregation during the formation of the coated film. The auxiliary dispersant may be a fluorochemical surfactant, a fluorine-containing polymer, a silicone polymer or a silicone oil.

In an embodiment, the fluorine-containing resin and the auxiliary dispersant are mixed with a small amount of a dispersing solvent by agitation, then the fluorine-containing resin and the auxiliary dispersant are dispersed in the dispersing solvent, then the obtained dispersion liquid is mixed with a liquid obtained by mixing and dissolving the charge transporting substance, the binder resin in another dispersing solvent, and then the obtained mixture is agitated and the components are dispersed by the aforementioned method.

The charge transporting layer 32 may be provided by, for example, an immersion coating method, a fountain extrusion coating method, a spray coating method, a roll coating method, a wire bar coating method, a gravure coating method, a bead coating method, a curtain coating method, a blade coating method or an air knife coating method.

The charge transporting layer 32 has a film thickness of preferably 5 to 50 μm, more preferably 10 to 45 μm.

Additives such as antioxidants and photostabilizers may be added to the photosensitive layer 3, in order to prevent the degradation of the electrophotographic photoreceptor 1-1 of the invention caused by ozone or an oxidative gas generated in the electrophotographic apparatus or by light or heat.

Examples of the antioxidant include hindered phenols, hindered amines, paraphenylenediamine, arylalkane, hydroquinone, spirochroman, spiroindanone, derivative of the foregoing compounds, organic sulfur compounds, and organic phosphor compounds.

The antioxidant may be a phenolic antioxidant. Examples of the phenolic antioxidant include 2,6-di-t-butyl-4-methylphenol, styrenized phenol, n-octadecyl-3-(3',5'-di-t-butyl-4'-hydroxyphenyl)propionate, 2,2'-methylene-bis(4-methyl-6-t-butylphenol), 2-t-butyl-6-(3'-t-butyl-5'-methyl-2'-hydroxybenzyl)-4-methylphenyl acrylate, 4,4'-butylidene-bis-(3-methyl-6-t-butylphenol), 4,4'-thio-bis-(3-methyl-6-t-butylphenol), 1,3,5-tris(4-t-butyl-3-hydroxy-2,6-dimethylbenzyl)isocyanurate, tetrakis-[methylene-3-(3',5'-di-t-butyl-4'-hydroxyphenyl)propionate]-methane, and 3,9-bis[2[3-(3-t-butyl-4-hydroxy-5-methylphenyl) propionyloxy]1,1-dimethylethyl]-2,4,8,10-tetraoxaspito[5,5]undecane.

Examples of hindered amine compounds as the antioxidants include bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensate, poly[{6-(1,1,3,3-tetramethylbutyl)imino-1,3,5-triazine-2,4-diimyl}{(2,2,6,6-tetramethyl-4-piperidyl) imino}hexamethylene{(2,3,6,6-tetramethyl-4-piperidyl) imino}], 2-(3,5-di-t-butyl-4-hydroxybenzyl)-2-n-butyl malonate bis(1,2,2,6,6-pentamethyl-4-piperidyl), and N,N'-bis(3-aminopropyl)ethylenediamine-2,4-bis[N-butyl-N-(1,2,2,6,6-pentamethyl-4-piperidyl)amino]-6-chloro-1,3,5-triazine condensate.

Examples of the organic sulfur-containing antioxidant include dilauryl-3,3'-thiodipropionate, dimyristyl-3,3'-thiodipropionate, distearyl-3,3'-thiodipropionate, pentaerythritol-tetrakis(β-lauryl-thiopropionate), ditridecyl-3,3'-thiodipropionate, and 2-mercaptobenzimidazole.

Examples of the organic phosphor-containing antioxidant include trisnonylphenyl phosphite, triphenyl phosphite, and tris(2,4-di-t-butylphenyl)phosphite.

The organic sulfur-containing antioxidant or the organic phosphor-containing antioxidant is called a secondary antioxidant. When a phenolic or an amine-type antioxidant is used together with such a secondary antioxidant, synergetic effects can be obtained.

The photostabilizer may be a derivatives of benzophenone, benzotriazole, dithiocarbamate, or tetramethylpiperidine.

Examples of the benzophenone-based photostabilizer include 2-hydroxy-4-methoxybenzophenone, 2-hydroxy-4-octoxybenzophenone, and 2,2'-di-hydroxy-4-methoxybenzophenone.

Examples of the benzotriazole-based photostabilizer include 2-(2'-hydroxy-5'-methylphenyl)-benzotriazole, 2-[2'-hydroxy-3'-(3",4",5",6"-tetra-hydrophithalimidemethyl)-5'-methylphenyl]-benzotriazole, 2-(2'-hydroxy-3'-t-butyl-5'-methylphenyl)-5-chlorobenzotriazole, 2-(2'-hydroxy-3'-t-butyl-5'-methylphenyl)-5-chlorobenzotriazole, 2-(2'-hydroxy-3',5'-t-butylphenyl)-benzotriazole, 2-(2'-hydroxy-5'-t-octylphenyl)-benzotriazole, and 2-(2'-hydroxy-3',5'-di-t-amylphenyl)-benzotriazole.

Examples of other antioxidants include 2,4-di-t-butylphenyl-3',5'-di-t-butyl-4'-hydroxybenzoate and nickel dibutyldithiocarbamate.

The photosensitive layer may further include an electron-accepting substance for the purposes of improving the sensitivity, reducing the residual potential and reducing the fatigue in repetitive uses.

Examples of the electron accepting substance include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. Fluorenone compounds, quinone compounds, and benzene derivatives having electron attracting substituents such as Cl, CN and $NO_2$ are preferable electron accepting compounds.

In the electrophotographic photoreceptor 1-1 having a multi-layered structure, the overcoat layer 5 is provided for preventing chemical changes of the charge transporting layer at charging, and for improving the mechanical strength of the photosensitive layer, thereby further improving resistances of the surface layer to abrasion and flaws.

The overcoat layer 5 may be a cured resin film containing a curable resin and a charge transporting compound, or a film including a suitable binder resin containing a conductive material. The overcoat layer preferably includes a charge transporting compound.

The curable resin may be any known resin. The curable resin preferably has a crosslinked structure from the viewpoint of the strength, the electric characteristics, and the durability of the image quality. The curable resin having a crosslinked structure may be a phenolic resin, an urethane resin, a melamine resin, a diallyl phthalate resin, or a siloxane resin.

The overcoat layer 5 is preferably a cured film including a compound represented by the following formula (I-1) or (I-2):

$$F\text{-}[D\text{-}Si(R^2)_{(3-a)}Q_a]_b \qquad \text{Formula (I-1)}$$

In the formula (I-1), F represents an organic group derived from a photofunctional compound; D represents a flexible subunit; $R^2$ represents a hydrogen atom, an alkyl group or a substituted or unsubstituted aryl group; Q represents a hydrolyzable group; a represents an integer of 1 to 3; and b represents an integer of 1 to 4;

$$F\text{—}((X)_nR^1\text{—}ZH)_m \qquad \text{Formula (I-2)}$$

In the formula (I-2), F represents an organic group derived from a positive hole transporting compound; $R^1$ represents an alkylene group; Z represents an oxygen atom, a sulfur atom, NH, $CO_2$ or COOH; m represents an integer of 1 to 4; X represents an oxygen atom or a sulfur atom; and n represents 0 or 1.

In the formulae (I-1) and (I-2), F represents a unit having a photoelectric characteristic, more specifically a photocarrier transporting characteristic, which may be a conventionally known charge transporting structure. More specifically, the unit represented by F may be a skeleton of a positive hole transporting compound or a skeleton of an electron transporting compound. Examples of the positive hole transporting compound include triarylamine compounds, benzidine compounds, arylalkane compounds, aryl-substituted ethylene compounds, stilbene compounds, anthracene compounds, and hydrazone compounds. Examples of the electron transporting compound include quinone compounds, fluorenone compounds, xanthone compounds, benzophenone compounds, cyanovinyl compounds, and ethylene compounds.

In the formula (I-1), $\text{—}Si(R^2)_{(3-a)}Q_a$ represents a substituted silicon group having a hydrolyzable group. The substituted silicon atoms in molecules of the compound represented by the formula (I-1) are crosslinked to each other to form three-dimensional Si—O—Si bonds. Thus, the substituted silicon group has a function of forming so-called inorganic glass network in the overcoat layer 5.

In the formula (I-1), D represents a flexible subunit. The flexible subunit connects the unit represented by F, which has a photoelectric characteristic, and the substituted silicon group involved in the three-dimensional inorganic glass network. The flexible unit is an organic group which imparts an appropriate flexibility to the rigid but fragile inorganic glass network and which improves the strength of the overcoat layer.

The flexible subunit D may be, for example, a divalent hydrocarbon group represented by $—C_nH_{2n}—$, $—C_nH_{(2n-4)}—$ or $—C_nH_{(2n-4)}—$ (wherein n represents an integer of 1 to 15), —COO—, —S—, —O—, $—CH_2—C_6H_4—$, —N═CH—, $—(C_6H_4)—(C_6H_4)—$, or a characteristic group comprised of an arbitrary combination of groups selected from the foregoing groups. The groups described above as examples of the flexible subunit D each may be substituted or non-substituted.

In the formula (I-1), b is preferably 2 or larger. When b is 2 or larger, the photofunctional organic silicon compound represented by the formula (I-1) contains two or more Si atoms; therefore the formation of the inorganic glass network is easier and the mechanical strength thereof is improved.

The compound represented by the formulae (I-1) or (I-2) is preferably a compound represented by the following formula (I-3). The compound represented by the formula (I-3) is a compound having the ability to transport positive holes (positive hole transporting substance). It is preferable to incorporate the compound represented by the formula (I-3) into the overcoat layer from the viewpoint of improvement in the photoelectric characteristics and the mechanical characteristics of the overcoat layer 5.

Formula (I-3)

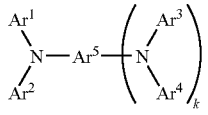

In the formula (I-3), $Ar^1$ to $Ar^4$ each independently represent a substituted or non-substituted aryl group; $Ar^5$ represents a substituted or non-substituted aryl group or arylene group; two to four selected from $Ar^1$ to $Ar^5$ each have a substituent represented by $-D-Si(R^2)_{(3-a)}Q_a$ or $—((X)_nR^1—ZH)_m$; D represents a flexible subunit; $R^2$ represents a hydrogen atom, an alkyl group, or a substituted or non-substituted aryl group; Q represents a hydrolyzable group; and a represents an integer of 1 to 3; $R^1$ represents an alkylene group; Z represents an oxygen atom, a sulfur atom, NH, $CO_2$ or COOH; m represents an integer of 1 to 4; X represents an oxygen atom or a sulfur atom; and n represents 0 or 1.

In the formula (I-3), $Ar^1$ to $Ar^5$ are preferably selected from the groups represented by the following formulae (I-4) to (I-10).

(I-4)

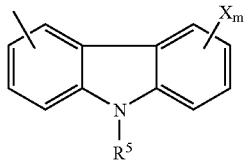

(I-5)

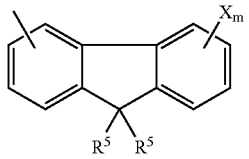

(I-6)

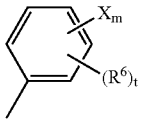

(I-7)

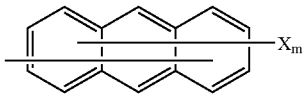

(I-8)

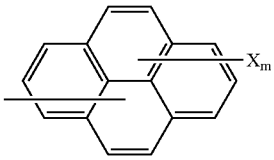

(I-9)

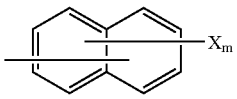

(I-10) $—Ar—(Z')_s—Ar—X_m$

In the formulae (I-4) to (I-10), $R^5$ represents a hydrogen atom, an alkyl group having 1 to 4 carbon atoms, a phenyl group which is substituted by a group or groups selected from alkyl groups each having 1 to 4 carbon atoms and alkoxy groups each having 1 to 4 carbon atoms, a non-substituted phenyl group, or an aralkyl group having 7 to 10 carbon atoms; $R^6$ represents a hydrogen atom, an alkyl group having 1 to 4 carbon atoms, an alkoxy group having 1 to 4 carbon atoms, or a halogen atom; X represents a group represented by $-D-Si(R^2)_{(3-a)}Q_a$ or $—((X)_nR^1—ZH)_m$ described above; m and s each independently represent 0 or 1; and t represents 1, 2, or 3.

Throughout the specification, if there are two or more groups represented by the same sign, any two of the groups may be the same as each other or different from each other. Throughout the specification, if there are two or more numbers represented by the same sign, any two of the numbers may be the same as each other or different from each other.

In the formula (I-10), Ar preferably represents a group represented by the following formula (I-11) or (I-12).

(I-11)

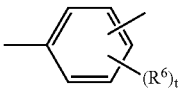

-continued (I-12)

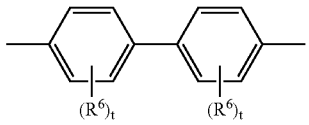

In the formulae (I-11) and (I-12), $R^6$ represents a hydrogen atom, an alkyl group having 1 to 4 carbon atoms, an alkoxy group having 1 to 4 carbon atoms, or a halogen atom; and t represents 1, 2, or 3.

In the formula (10), Z' preferably represents a group represented by the following formula (I-13) or (I-14).

As described above, X represents $-D-Si(R^2)_{(3-a)}Q_a$ or $—((X)_nR^1—ZH)_m$ in the formulae (I-4) to (I-10). D represents a divalent hydrocarbon group represented by $—C_gH_{2g}—$, $—C_mH_{2m-2}—$, $—C_nH_{2n-4}—$, —N═CH—, —O—, —COO—, —S—, —(CH)β-, a group represented by the formula (I-11) or (I-12), or a group represented by the following formula (I-13) or (I-14), wherein g represents an integer of 1 to 15; m represents an integer of 2 to 15; n represents an integer of 3 to 15; and β represents an integer of 1 to 10.

(I-13)

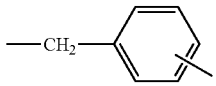

(I-14)

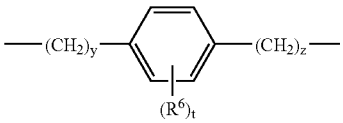

In the formula (I-14), y and z each independently represent an integer of 1 to 5; t represents an integer of 1 to 3; and $R^6$ represents a hydrogen atom, an alkyl group having 1 to 4 carbon atoms, an alkoxy group having 1 to 4 carbon atoms or a halogen atom.

In the formula (I-3), $Ar^5$ represents a substituted or non-substituted aryl or arylene group. When k represents 0, $Ar^5$ is preferably a group represented by any one of the following formula (I-15) to (I-19). When k represents 1, $Ar^5$ is preferably a group represented by any one of the following formula (I-20) to (I-24).

(I-15)

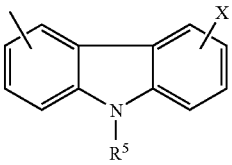

(I-16)

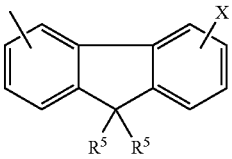

-continued (I-17)

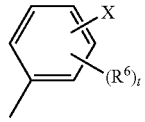

(I-18)

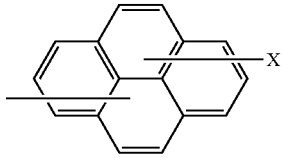

(I-19) $—Ar—(Z)_s—Ar—X$ (I-20)

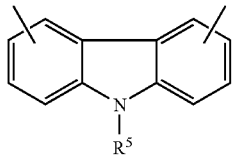

(I-21)

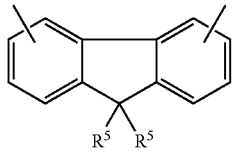

(I-22)

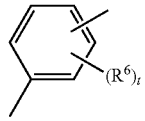

(I-23)

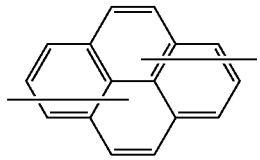

(I-24) $—Ar—(Z)_s—Ar—$

In the formulae (I-15) to (I-24), $R^5$ represents a hydrogen atom, an alkyl group having 1 to 4 carbon atoms, a phenyl group which is substituted by a group or groups selected from alkyl groups each having 1 to 4 carbon atoms and alkoxy groups each having 1 to 4 carbon atoms, a non-substituted phenyl group, or an aralkyl group having 7 to 10 carbon atoms; $R^6$ represents a hydrogen atom, an alkyl group having 1 to 4 carbon atoms, an alkoxy group having 1 to 4 carbon atoms, or a halogen atom; s represents 0 or 1; and t represents 1, 2, or 3.

Z in the formulae (I-19) and (I-24) is preferably a group represented by any of the following formulae (I-25) to (I-32).

(I-25) $—(CH_2)_q—$ (I-26) $—(CH_2CH_2O)_r—$ (I-27)

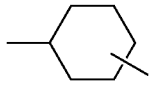

-continued (I-28)

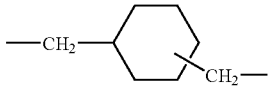

(I-29)

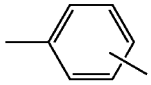

(I-30)

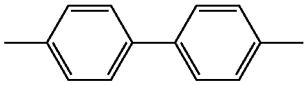

(I-31)

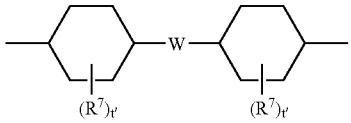

(I-32)

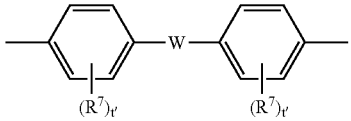

In the formulae (I-25) to (I-32), $R^7$ represents a hydrogen atom, an alkyl group having 1 to 4 carbon atoms, an alkoxy group having 1 to 4 carbon atoms, or a halogen atom; W represents a divalent group; q and r each independently represent an integer of 1 to 10; and t' represents 1 or 2.

W in the formula (I-31) or (I-32) is preferably selected from the groups represented by the following formulae (I-33) to (I-41). In the formula (I-40), s' represents 0, 1, 2, or 3.

$—CH_2—$ (I-33)

$—C(CH_3)_2—$ (I-34)

—O— (I-35)

—S— (I-36)

$—C(CF_3)_2—$ (I-37)

$—Si(CH_3)_2—$ (I-38)

(I-39)

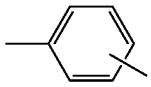

(I-40)

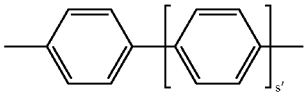

(I-41)

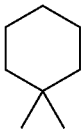

Compounds 1-274 shown in tables 1-55of JP-A No. 2001-83728 (the disclosure of which is incorporated herein by reference) may be used in the invention, which are examples of the compound represented by the formula (I-3).

Only a single charge transporting compound represented by the formula (I-1) may be used or two or more charge transporting compounds represented by the formula (I-1) may be used.

The charge transporting compound represented by the formula (I-1) may be used in combination with a compound represented by a following formula (II), for the purpose of further improving the mechanical strength of the cured film.

Formula (II) $B—(Si(R^2)_{(3-a)}Q_a)_2$ Formula (II)

In the formula (II), B represents a divalent organic group; $R^2$ represents a hydrogen atom, an alkyl group or a substituted or non-substituted aryl group; Q represents a hydrolyzable group; and a represents an integer of 1to 3.

The compound represented by the formula (II) is preferably a compound represented by any one of the following formula (II-1) to (II-5), which should not be construed as limiting the invention.

In the formulae (II-1) to (II-5), $T^1$ and $T^2$ each independently represent a divalent or trivalent hydrocarbon group which may be branched; A represents $-D-Si(R^2)_{(3-a)}Q_a$ described above; h, i and j each independently represent an integer of 1 to 3; the total number of groups represented by A in the molecule is 2 or more.

(II-1) $T^1$—[A]$_j$ (II-2)

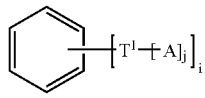

(II-3)

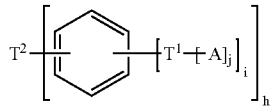

(II-4) HN—[$T^1$—A]$_2$ (II-5) $T^2$—[H N—$T^1$—A]$_j$

In the following, preferable examples of the compound represented by the formula (II) are shown below. In the examples, Me, Et and Pr respectively represent a methyl group, an ethyl group and a propyl group.

(III-1)

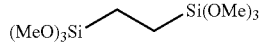

(III-2)

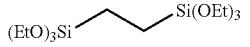

(III-3)

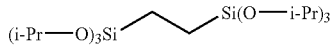

(III-4)

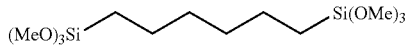

(III-5)

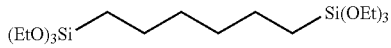

(III-6)

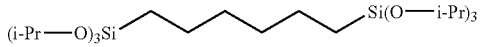

-continued (III-7)

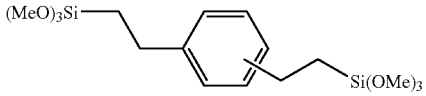

(III-8)

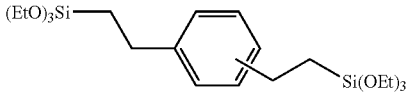

(III-9)

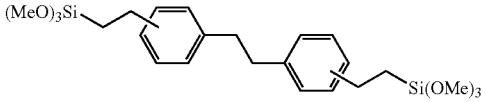

(III-10)

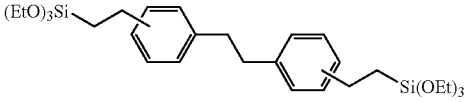

(III-11)

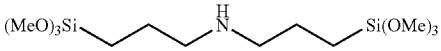

(III-12)

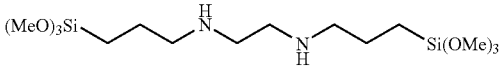

| | |
|---|---|
| (III-13) | $(MeO)_2MeSi(CH_2)_2SiMe(OMe)_2$ |
| (III-14) | $(EtO)_2EtSi(CH_2)_2SiEt(OEt)_2$ |
| (III-15) | $(MeO)_2MeSi(CH_2)_6SiMe(OMe)_2$ |
| (III-16) | $(EtO)_2EtSi(CH_2)_6SiEt(OEt)_2$ |
| (III-17) | $(MeO)_2MeSi(CH_2)_{10}SiMe(OMe)_2$ |
| (III-18) | $(EtO)_2EtSi(CH_2)_{10}SiEt(OEt)_2$ |
| (III-19) | $MeOMe_2Si(CH_2)_6SiMe_2OMe$ |

Another crosslinkable compound may be used in combination with the compound represented by the formula (I-1) or (I-2). The crosslinkable compound may be a silane coupling agent or a commercially available silicone hard coating agent.

The silane coupling agent may be vinyltrichlorosilane, vinyltrimethoxysilane, vinyltriethoxysilane, γ-glycidoxypropylmethyl diethoxysilane, γ-glycidoxypropyl triethoxysilane, γ-glycidoxypropyl trimethoxysilane, γ-aminopropyl triethoxysilane, γ-aminopropyl trimethoxysilane, γ-aminopropylmethyl dimethoxysilane, N-β(aminoethyl)γ-aminopropyl triethoxysilane, tetramethoxysilane, methyltrimethoxysilane, or dimethyldimethoxysilane.

The commercially available hard coating agent may be KP-85, CR-39, X-12-2208, X-40-9740, X-41-1007, KNS-5300, X-40-2239 (foregoing manufactured by Shin-etsu Chemical Co.), AY42-440, AY42-441 and AY49-208 (foregoing manufactured by Dow Corning Toray Silicone Co.).

The overcoat layer 5 may further include a fluorine-containing compound for the purpose of obtaining a surface lubricating property. An increase in the surface lubricating property can reduce a friction coefficient with the cleaning member and can improve the wear resistance. The increase in the surface lubricating property also has an effect of preventing a discharge product, a developer and paper dusts from adhering to the surface of the electrophotographic photoreceptor, thereby extending the service life thereof.

As the fluorine-containing compound, the overcoat layer 5 may include a fluorine-containing polymer such as polytetrafluoroethylene as it is, or fine particles of such a polymer.

When the overcoat layer 5 is a cured film formed by the compound represented by the formula (I), it is preferable to add a fluorine-containing compound capable of reacting with alkoxysilane thereby allowing the fluorine-containing compound to be involved in the crosslinking network of the cured film.

Specific examples of such a fluorine-containing compound include (tridecafluoro-1,1,2,2-tetrahydrooctyl)triethoxysilane, (3,3,3-trifluoropropyl)trimethoxysilane, 3-heptafluoroisopropoxy)propyl triethoxysilane, 1H,1H,2H,2H-perfluoroalkyl triethoxysilane, 1H,1H,2H,2H-perfluorodecyl triethoxysilane, and 1H,1H,2H,2H-perfluorooctyl triethoxysilane.

The content of the fluorine-containing compound in the overcoat layer 5 is preferably 20% by weight or smaller. If the content is larger than 20% by weight, defects in the film forming property of the crosslinked cured film may occur.

The aforementioned overcoat layer 5 has a sufficient oxidation resistance. However, an antioxidant may be further added in order to obtain an even stronger oxidation resistance.

The antioxidant is preferably a hindered phenol antioxidant or a hindered amine antioxidant. Other antioxidants are also usable. For example, the antioxidant may be a known antioxidant such as an organic sulfur based antioxidant, a phosphite antioxidant, a dithiocarbamate antioxidant, a thiourea antioxidant, or a benzimidazole antioxidant. The content of the antioxidant in the overcoat layer 5 is preferably 15% by weight or lower, more preferably 10% by weight or lower.

Examples of the hindered phenol antioxidant include 2,6-di-t-butyl-4-methylphenol, 2,5-di-t-butylhydroquinone, N,N'-hexamethylenebis(3,5-di-t-butyl-4-hydroxyhydrocinnamide, 3,5-di-t-butyl-4-hydroxybenzyl phosphonate diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenyl), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis(3-methyl-6-t-butylphenol).

The overcoat layer 5 may further include other known additives which are used for conventional film formation may be added, such as a leveling agent, an ultraviolet absorber, a photostabilizer, and a surfactant.

The overcoat layer 5 may be formed by coating a mixture of the aforementioned materials and additives on the photosensitive layer, followed by heating. In this manner a three-dimensional crosslinking curing reaction proceeds to form a strong cured film. The heating temperature is not particularly limited as long as the underlying photosensitive layer is not influenced. The heating temperature is preferably within the range of from room temperature to 200° C., more preferably within the range of from 100° C. to 160° C.

In the formation of the overcoat layer 5, the crosslinking curing reaction may be executed with or without a suitable catalyst. The catalyst may be: an acid catalyst such as hydrochloric acid, sulfuric acid, phosphoric acid, formic acid, acetic acid or trifluoroacetic acid; a base such as ammonia or triethylamine; an organic tin compound such as dibutyl tin diacetate, dibutyl tin dioctoate or stannous octoate; an organic titanium compound such as tetra-n-butyl titanate or tetraisopropyl titanate; an iron salt of an organic carboxylic acid; a manganese salt of an organic carboxylic acid; a cobalt salt of an organic carboxylic acid; a zinc salt of an organic carboxylic acid; a zirconium salt of an organic carboxylic acid; or an aluminum chelate compound.

A solvent may be added to the coating liquid for forming the overcoat layer 5, for the purpose of making the coating easier. The solvent may be water or an ordinary organic solvent such as methanol, ethanol, n-propanol, i-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, dimethyl ether or dibutyl ether. Only a single solvent may be used, or a mixture of two or more kinds of solvents may be used.

In the formation of the overcoat layer 5, the coating method may be an ordinary coating method such as blade coating, Meyer bar coating, spray coating, immersion coating, bead coating, air knife coating, or curtain coating.

The overcoat layer 5 has a thickness of preferably 0.5 to 20 μm, more preferably 2 to 10 μm.

In the electrophotographic photoreceptor 1-1, functional layers which are disposed above the charge generating layer 31 have a thickness of 50 μm or smaller, preferably 40 μm or smaller, from the viewpoint of obtaining a high resolution. When the functional layers are thin, the combination of the particle-dispersed undercoat layer of the invention and the highly strong overcoat layer 5 is particularly effective.

The structure of the electrophotographic photoreceptor 1-1 is not limited to the aforementioned structure. The electrophotographic photoreceptor 1-1 may be constituted without the intermediate layer 4 and/or the overcoat layer 5. In an embodiment, the electrophotographic photoreceptor 1-1 is comprised of the conductive support 7, and the undercoat layer 2 and the photosensitive layer 3 provided on the support 7. In another embodiment, the photoreceptor 1-1 is comprised of the conductive support 7, and the undercoat layer 2, the intermediate layer 4 and the photosensitive layer 3 successively provided on the conductive support 7. In another embodiment, the photoreceptor 1-1 is comprised of the conductive support 7, and the undercoat layer 2, the photosensitive layer 3 and the overcoat layer 5 successively provided on the conductive support 7.

The positions of the charge generation layer 31 and the charge transporting layer 32 may be switched. The photosensitive layer 3 may have a single-layer structure. In such a case, the photosensitive layer may be provided thereon with the overcoat layer, or provided with both the undercoat layer and the overcoat layer. Further, an intermediate layer may be provided on the undercoat layer, as explained in the foregoing. When the photosensitive layer has a single-layer structure, the photosensitive layer may be formed by coating a binder resin containing a charge generating substance and/or a charge transporting substance to form a film. The charge generating substance and the charge transporting substance may be selected from the substances mentioned in the description of the multi-layered photosensitive layer.

The charging unit is described in the following. The charging unit of the image forming apparatus of the invention may be a known charging unit. For example, the charging unit may be non-contact charging unit such as a corotron or a scorotron, or a contact charging unit such as a charging roll, a charging brush, or a charging film. In the exemplary apparatus shown in FIG. 1, the charging unit 1-3 is a contact charging unit.

Contact charging units apply an electric potential to a conductive member which is brought into contact with the surface of the photoreceptor, thereby charging the surface of the photoreceptor. The shape of the conductive member may be a brush shape, a blade shape, a pin electrode shape, or a roller shape, preferably a roller shape. Usually, the roller-shaped conductive member is comprised of, in the order of the exterior to the interior, a electric resistance layer, an elastic layer supporting the electric resistance layer, and a core material. A overcoat layer may be optionally provided on the exterior surface of the electric resistance layer.

The roller-shaped conductive member is rotated at the same peripheral velocity as that of the photoreceptor by being brought in contact with the photoreceptor and functions as the charging unit, even without a driving unit for the roller-shaped conductive member. However, a driving unit for the roller-shaped conductive member may be provided to the roller-shaped conductive member so as to rotate the roller-shaped conductive member at a peripheral velocity which is different from that of the photoreceptor. The core material of the roller-shaped conductive member may be made of a conductive substance which is generally iron, copper, brass, stainless-steel, aluminum, nickel, or the like, but may also be a molded resin containing dispersed conductive particles. The elastic layer may be made of a conductive or semi-conductive substance. The elastic layer is usually made of a rubber containing conductive or semi-conductive particles dispersed therein. Examples of the rubber include EPDM, polybutadiene, natural rubber, polyisobutylene, SBR, CR, NBR, silicone rubber, urethane rubber, epichlorohydrin rubber, SBR, thermoplastic elastomer, norbornene rubber, fluorosilicone rubber, and ethylene oxide rubber. The conductive particles or semi-conductive particles may be made of a substance or substances selected from: carbon black; metals such as zinc, aluminum, copper, iron, nickel, chromium, and titanium; and metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO, and MgO. The material for the electric resistance layer or the overcoat layer may be a material obtained by dispersing conductive or semi-conductive particles in a binder resin and adjusting the electric resistance of the dispersion. The electric resistance of the electric resistance layer or the overcoat layer is $10^3$ Ωcm to $10^{14}$ Ωcm, preferably $10^5$ Ωcm to $10^{12}$ Ωcm, more preferably $10^7$ Ωcm to $10^{12}$ Ωcm. The total thickness of the electric resistance layer and the overcoat layer may be 0.01 to 1000 μm, preferably 0.1 to 500 μm, more preferably 0.5 to 100 μm. Examples of the binder resin include acrylic resins, cellulose resins, polyamide resins, methoxymethylated nylon, ethoxymethylated nylon, polyurethane resins, polycarbonate resins, polyester resins, polyethylene resins, polyvinyl resins, polyarylate resins, polythiophene resins, polyolefin resins such as PFA, FEP, and PET, and styrene butadiene resins. The conductive or semi-conductive particles may be made of a substance which may be selected from carbon black, the metals, and the metal oxides, which are described above as the substance of the conductive or semi-conductive particles in the elastic layer. The electric resistance layer or the overcoat layer may optionally include an antioxidant such as a hindered phenol or a hindered amine, a filler such as clay or kaolin, or a lubricant such as a silicone oil. These layers may be formed by a blade coating method, a Meyer bar coating method, a spray coating method, an immersion coating method, a bead coating method, an air knife coating method, or a curtain coating method.

Electric potential is applied to the conductive member so as to charge the photoreceptor. The electric potential to be applied is preferably a direct current voltage or a superposition of a direct current potential and an alternating voltage. The direct current voltage may be determined in accordance with the desired charging potential of the photoreceptor, and is preferably ±50 V to ±2000V, more preferably ±100 V to ±1500 V. When the superposition of a direct current voltage and an alternating voltage is used, the difference in voltage between the higher peak and the lower peak is preferably 400 V to 1,800 V, more preferably 800 V to 1,600 V, still more preferably 1,200 V to 1,600 V. The frequency of the alternating current is preferably 50 to 20,000 Hz, more preferably 100 to 5,000 Hz.

The exposure unit 1-5 may be such an optical system that the electrophotographic photoreceptor 1-1 is imagewise exposed to a light emitted from a light source such as a semi-conductor laser, an LED (Light Emitting Diode), or a liquid crystal shutter. When an exposure unit which can expose the photoreceptor to an incoherent light, it is possible to prevent the interference fringes caused by the light reflected by the conductive support and the light reflected by the photosensitive layer.

The developing unit 1-2 may be a known developing unit which uses a one-component or two-component, positive or negative developer. The shape of the toner to be used is not particularly limited, and is preferably a spherical shape from the viewpoint of improving the image quality and being friendly to the environment. The toner in the spherical shape refers to a toner having an average shape coefficient SF1 of 100 to 150, more preferably 100 to 140, which enables a high transfer efficiency. When the average shape coefficient SF1 is larger than 140, the transfer efficiency is lowered and the degradation of the image quality of the printed samples is observable.

The spherical toner includes a binder resin and a colorant. The spherical toner has a particle size of preferably 2 to 12 μm, more preferably 3 to 9 μm.

The binder resin may be, for example, a homopolymer of a styrene, a monoolefin, a vinylester, an x-methylene aliphatic monocarboxylic ester, a vinyl ether, or a vinyl ketone; or a copolymer of monomers selected from the above monomers. Examples of the binder resin include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, polypropylene, polyester, polyurethane, epoxy resins, silicone resins, polyamides, modified rosins, and paraffin waxes.

Examples of the colorant include: magnetic powder such as magnetite powder and ferrite powder, carbon black, aniline blue, chalcoyl blue, chrome yellow, ultramarine blue, DUPONT OIL RED, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment yellow 17, C.I. pigment blue 15:1, and C.I. pigment blue 15:3.

A Known additive such as a charge control agent, a release agent, and other inorganic particles may be added to the spherical toner as internal additives and/or external additive.

The release agent may be typically a low-molecular polyethylene, low-molecular polypropylene, Fischer-Tropsch wax, Montan wax, Carbana wax, rice wax, or candelilla wax.

The charge control agent may be a known charge control agent, and may be an azo metal complex compound, a metal complex compound of slicylic acid, or a resin-type charge control agent having a polar group.

The inorganic metal particles which can be added to the spherical toner are preferably small inorganic particles having an average primary particle size of 40 nm, in consideration of the powder mobility and the charge control. The small inorganic metal particles may be used in combination with another kind of inorganic particles having larger particle size or with organic particles, in order to reduce the adhesiveness. The inorganic particles may be selected from known inorganic particles. The inorganic particles having a smaller particle size is preferably subjected to a surface treatment in order to improve the dispersibility and the powder mobility.

The preparation method of the spherical toner is not particularly limited and may be prepared by a known method. For example, any of the following methods may be employed; a kneading-pulverizing method; a method comprising obtaining particles by a kneading-pulverizing method, and modifying the shape of the particles by mechanical impact, force, or heat energy; an emulsion polymerization method, and dissolution suspension method. In an embodiment, the spherical toner obtained by any of the above methods is used as a core, and aggregative particles are allowed to adhere to the core and then heated to fuse, thereby giving a toner having a core-shell structure. When an external additive is added, in an embodiment, the spherical toner and the external additive are mixed by a Henschel mixer or a V-blender to form a toner. When the spherical toner is produced by a wet process, an external additive may be added in a wet manner.

The intermediate transfer member 1-8 may comprise a traditional conductive thermoplastic resin. The conductive thermoplastic resin may be obtained by incorporating a conductive agent to a resin such as: a polyimide resin; a polycarbonate (PC) resin; polyvinylidene fluoride (PVDF); polyalkylene terephthalate (PAT); or a blend material such as ethylene-tetrafluoroethylene copolymer (ETFE)-PC, ETFE-PAT, or PC-PAT. A polyimide resin containing a conductive agent dispersed therein is preferable because of its high mechanical strength.

The conductive agent may be carbon black, a metal oxide, or a conductive polymer such as polyaniline.

When the intermediate transfer member 1-8 is in the form of a belt, the thickness of the belt may be determined in accordance with the hardness of the material, and is preferably 50 to 500 μm, more preferably 60 to 150 μm.

The polyimide resin belt containing a conductive agent dispersed therein may be produced by a method described in JP-A No. 63-311263, the disclosure of which is incorporated by reference herein. Specifically, in the method: carbon black as the conductive agent is dispersed in a solution of polyamide acid as a precursor of the polyimide such that the content of the carbon black in the dispersion liquid is 5 to 20% by weight; the dispersion liquid is subjected to a flow casting onto a metal drum and dried; then the film is peeled away from the drum and stretched at a high temperature to form a polyimide film; and then the polyimide film is cut into an appropriate size to give an endless belt. Generally, the film is formed by the following process: the polyamide acid solution (for forming the film) containing the conductive agent therein is poured into a cylindrical metal mold; the polyamide solution is heated to 100° C. to 200° C. and the metal mold is rotated at the rotating rate of 500 to 2000 rpm at the temperature to form a film by the centrifugal molding process; then the obtained film in partially cured state is taken out of the metal mold and put on a metal core; and then the film is allowed to undergo a polyimide formation reaction (ring closure reaction of polyamide acid) at 300° C. or higher to complete the curing. In another embodiment, the polyamide acid solution containing the conductive agent is dropped onto a metal sheet so that the thickness of the polyamide acid solution is constant; then the polyamide acid solution is heated to 100° C. to 200° C. to remove most of the solvent content; and then the film is stepwise heated to 300° C. or higher to form a polyimide film.

The intermediate transfer member 1-8 may have a surface layer.

The cleaning unit 1-6 removes toner remaining on the surface of the electrophotographic photoreceptor 1-1 after the transfer. Owing to the action of the cleaning unit 1-6, the cleaned electrophotographic photoreceptor 1-1 can be used for repeated image forming cycles described above. In the exemplary image forming apparatus shown in FIG. 1, the cleaning unit 1-6 comprises a cleaning blade. However, the cleaning method may be selected from other cleaning methods such as the brush cleaning and the roll cleaning. In a preferable embodiment, a cleaning blade is used in the cleaning unit. The cleaning blade material may be urethan rubber, neoprene rubber, or silicone rubber.

The electrophotographic apparatus of the invention may further comprise a charge removing unit such as an erase light irradiating unit. The charge removing unit prevents the electric potential of the photoreceptor 1-1 from remaining after the image formation cycle, thus improving the image quality.

The exemplary image forming apparatus shown in FIG. 1 is a tandem-type color image forming apparatus. However, the image forming apparatus of the invention is not limited to the tandem type. For example, the image forming apparatus of the invention may be an image forming apparatus having a single image forming unit, such as a monochromatic image forming apparatus or a color image forming apparatus having a rotary-type developing unit (rotating developing unit). The rotary-type developing unit refers to such a developing unit that a plurality of developing elements are rotationally moved so as to allow the required developing element to face the photoreceptor, thereby sequentially forming toner images of respective colors on the photoreceptor.

The invention also provides a process cartridge comprising the photoreceptor and at least one of the charging unit, the developing unit, the transfer unit, and the cleaning unit. The process cartridge is attachable to the image forming apparatus but detachable from the image forming apparatus. Also in this cartridge, the time required for the processes from the charging to development is changeable since the peripheral velocity of the photoreceptor is controlled, for example, by a driving unit. The process cartridge of the invention comprises the controlling unit (such as the driving unit) which controls the peripheral velocity of the photoreceptor. However, in the image forming apparatus of the invention, the controlling unit may be provided independently from a process cartridge.

EXAMPLES

The present invention will be explained using Examples. However, the Examples should not be construed as limiting the invention.

Example 1

100 parts by weight of zinc oxide (having an average particle size of 70 nm and a specific surface of 15 $m^2/g$, manufactured by Tayka Corporation) is mixed with 500 parts by weight of tetrahydrofuran under agitation. 1.25 parts by weight of a silane coupling agent (KBM603 manufactured by Shin-etsu Chemical Co., Ltd.) is added thereto and the mixture is stirred for 2 hours. Thereafter, tetrahydrofuran is removed by reduced-pressure distillation, and the zinc oxide particles coated with the silane coupling agent is baked at 120° C. for 3 hours, to give a surface-treated zinc oxide pigment.

60 parts by weight of the obtained zinc oxide pigment, 25 parts by weight of methyl ethyl ketone, 0.6 part by weight of alizarine, and 13.5 parts by weight of blocked isocyanate (SUMIDUR3175 manufactured by Sumika Bayer Urethane Co., Ltd.) as a curing agent are mixed with 38 parts by weight of a solution obtained by dissolving 15 parts by weight of a butyral resin (BM-1 manufactured by Sekisui Chemical Co., Ltd.) in 85 parts by weight of methyl ethyl ketone. Then, the mixture is subjected to a dispersing treatment for 2 hours to form a dispersion liquid, using a sandmill with glass beads having a particle size of 15 mm. The obtained dispersing liquid is further mixed with 0.005 part by weight of dioctyltin dilaurate as a catalyst and 4.0 parts by weight of silicone resin particles (TOSPEARL 145, manufactured by GE Toshiba Silicones), thus a coating liquid for forming an undercoat layer is obtained. The coating liquid is coated on an aluminum support by an immersion coating method, then dried and cured at 170° C. for 40 minutes to give an undercoat layer having a thickness of 25 μm.

Then, a photosensitive layer is formed on the undercoat layer. The formation of the photosensitive layer is conducted as follows: a mixture of 15 parts by weight of hydroxygallium phthalocyanine as a charge generating substance and 10 parts by weight of vinyl chloride-vinyl acetate copolymer resin (VMCH, manufactured by Nippon Unicar Co., Ltd.) as a binder resin are dispersed in 200 parts by weight of n-butyl acetate by a sandmill with glass beads having a particle size of 1 mm for 4 hours, wherein the hydroxygallium phthalocyanine has diffraction peaks at least at Bragg angles ($2\theta \pm 0.2°$) of 7.3°, 16.0°, 24.9°, and 28.0° with respect to the CuKα characteristic X rays; the obtained dispersion liquid is mixed with 175 parts by weight of n-butyl acetate and 180 parts by weight of methyl ethyl ketone, and the mixture is stirred to give a coating liquid for forming a charge generating layer; and thereafter the coating liquid is coated on the undercoat layer by an immersion coating method, then dried at room temperature to form a charge generating layer having a thickness of 0.2 μm.

Then, 1 part by weight of tetrafluoroethylene resin particles, 0.02 part by weight of a fluorine-containing graft polymer, 5 parts by weight of tetrahydrofuran, and 2 parts by weight of toluene are mixed well to give a tetrafluoroethylene resin particle suspension. Then, 4 parts by weight of N,N'-diphenyl-N,N'-bis(3-methylphenyl)-[1,1']biphenyl-4,4'-diamine as a charge transporting substance and 6 parts by weight of bisphenol Z type polycarbonate resin (having a viscosity-average molecular weight of 40,000) are dissolved in a mixture of 23 parts by weight of tetrahydrofuran and 10 parts by weight of toluene. The tetrafluoroethylene resin particle suspension obtained above is added thereto and the mixture is stirred, then subjected to a dispersing treatment using a high-pressure homogenizer (LA-33S, manufactured by Nanomizer Co., Ltd.) equipped with a penetrating chamber having a minute flowpaths to heighten the pressure up to 400 $kgf/cm^2$ ($3.92\times10^{-1}$ Pa), the dispersing treatment being repeated 6 times. By the dispersing treatment, a tetrafluoroethylene resin particle dispersion liquid is obtained. The tetrafluoroethylene resin particle dispersion liquid is mixed with 0.2 part by weight of 2,6-di-t-butyl-4-methylphenol to give a coating liquid for forming a charge transporting layer. The coating liquid is coated on the charge generating layer and dried at 115° C. for 40 minutes to form a charge transporting layer having a thickness of 32 μm.

Thus obtained photoreceptor is mounted on a modified full-color printer DOCUCENTRE COLOR 400 (manufactured by Fuji Xerox Co., Ltd.) equipped with a contact charging unit and an intermediate transfer unit, and used for printing tests at a charging potential of −700 V in each of a low-speed mode (the time between charging to development is 300 msec), a normal mode (the time between charging to development is 200 msec), and a high-speed mode (the time between charging to development is 100 msec). The results are shown in Table 1.

Examples 2 to 4

Electrophotographic photoreceptors are produced in the same manner as in Example 1, except that the surface-treated metal oxide and the acceptor compound are changed to the substances shown in Table 1.Then, the characteristics of the obtained photoreceptors are evaluated in the same manner as in Example 1. The results are shown in Table 1.

Comparative Examples 1

Electrophotographic photoreceptors are produced in the same manner as in Example 1, except that the acceptor compound is omitted. Then, the characteristics of the obtained photoreceptor are evaluated in the same manner as in Example 1. The results are shown in Table 1.

TABLE 1

| | | | Time between charging and development | | |
|---|---|---|---|---|---|
| | Acceptor compound | Image quality defects | Low-speed mode 300 msec | Normal mode 200 msec | High-speed mode 100 msec |
| Example 1 | Alizarin | Fogging | undetectable | undetectable | undetectable |
| | | Black spots | undetectable | undetectable | undetectable |
| | | Image memory | undetectable | undetectable | undetectable |
| Example 2 | 1-hydroxy anthraquinone | Fogging | hardly detectable | undetectable | undetectable |
| | | Black spots | hardly detectable | undetectable | undetectable |
| | | Image memory | undetectable | undetectable | undetectable |
| Example 3 | Purprin | Fogging | hardly detectable | undetectable | undetectable |
| | | Black spots | hardly detectable | undetectable | undetectable |
| | | Image memory | undetectable | undetectable | undetectable |
| Example 4 | 2-amino-3-hydroxy anthraquinone | Fogging | hardly detectable | undetectable | undetectable |
| | | Black spots | hardly detectable | undetectable | undetectable |
| | | Image memory | undetectable | undetectable | undetectable |
| Comparative Example 1 | — | Fogging | occur severely | occur moderately | undetectable |
| | | Black spots | occur severely | occur moderately | undetectable |
| | | Image memory | occur severely | occur severely | occur moderately |

The invention provides an image forming apparatus and a process cartridge both of which can suppress the occurrence of fogging of the printed image, black spots on the printed image, and image memory even when the process condition is switched among different process conditions requiring respectively different time for the processes from charging to development.

What is claimed is:

1. An image forming apparatus comprising an electrophotographic photoreceptor, a charging unit, an exposure unit, a development unit, and a transfer unit, wherein:

the image forming apparatus conducts charging, exposure, development, and transfer while moving a circumferential surface of the electrophotographic photoreceptor in a predetermined direction;

the image forming apparatus further comprises a controlling unit which controls a moving velocity of the circumferential surface of the electrophotographic photoreceptor so that a time required for processes from charging to development is changeable;

the electrophotographic photoreceptor includes an undercoat layer and a photosensitive layer; and the undercoat layer has a thickness of 15 to 50 μm and includes a metal oxide particle and an acceptor compound having a hydroxyl group, wherein the acceptor compound having the hydroxyl group is selected from the group consisting of monohydroxyanthraquinone, trihydroxyanthraquinone and aminohydroxyanthraquinone;

wherein the acceptor compound is reacted with the metal oxide particle; and wherein the metal oxide particle was subjected to a surface treatment with a coupling agent.

2. The image forming apparatus according to claim 1, wherein the controlling unit can switch among a plurality of control modes including a normal mode, a low-speed mode, and a high-speed mode, which satisfy the conditions represented by the following formulae (1) and (2):

$$T_{low} \geqq (1/3)T \quad \text{Formula (1):}$$

$$T_{high} \leqq 3T \quad \text{Formula (2):}$$

wherein in the formulae (1) and (2), T represents the time required for processes from charging to development in the normal mode; $T_{low}$ represents the time required for processes from charging to development in the low-speed mode; and $T_{high}$ represents the time required for processes from charging to development in the high-speed mode.

3. The image forming apparatus according to claim 1, wherein the coupling agent is a silane coupling agent.

4. The image forming apparatus according to claim 1, wherein the metal oxide particle includes a substance selected from titanium oxide, zinc oxide, tin oxide, and zirconium oxide.

5. The image forming apparatus according to claim 1, wherein the charging unit is a contact charging unit which charge the electrophotographic photoreceptor by contacting the electrophotographic photoreceptor.

6. A color image forming apparatus comprising a plurality of image forming units each of which comprises an electrophotographic photoreceptor, a charging unit, an exposure unit, a development unit, and a transfer unit, wherein:

in each image forming unit, the image forming apparatus conducts charging, exposure, development, and transfer while moving a circumferential surface of the electrophotographic photoreceptor in a predetermined direction;

each image forming unit further comprises a controlling unit which controls a moving velocity of the circumferential surface of the electrophotographic photoreceptor so that a time required for processes from charging to development is changeable;

the electrophotographic photoreceptor includes an undercoat layer and a photosensitive layer; and the undercoat layer has a thickness of 15 to 50 μm and includes a metal oxide particle and an acceptor compound having a hydroxyl group, wherein the acceptor compound having the hydroxyl group is selected from the group consisting of monohydroxyanthraquinone, trihydroxyanthraquinone and aminohydroxyanthraquinone;

wherein the acceptor compound is reacted with the metal oxide particle; and wherein the metal oxide particle was subjected to a surface treatment with a coupling agent.

7. The color image forming apparatus according to claim 6, wherein the controlling unit can switch among a plurality of control modes including a normal mode, a low-speed mode, and a high-speed mode, which satisfy the conditions represented by the following formulae (1) and (2):

$$T_{low} \geqq (1/3)T \quad \text{Formula (1):}$$

$$T_{high} \leqq 3T \quad \text{Formula (2):}$$

wherein in the formulae (1) and (2), T represents the time required for processes from charging to development in the normal mode; $T_{low}$ represents the time required for processes from charging to development in the low-speed mode; and $T_{high}$ represents the time required for processes from charging to development in the high-speed mode.

8. The color image forming apparatus according to claim 6, wherein the coupling agent is a silane coupling agent.

9. The color image forming apparatus according to claim 6, wherein the metal oxide particle includes a substance selected from titanium oxide, zinc oxide, tin oxide, and zirconium oxide.

10. The color image forming apparatus according to claim 6, wherein the charging unit is a contact charging unit which charges the electrophotographic photoreceptor by contacting the electrophotographic photoreceptor.

11. The color image forming apparatus according to claim 6, wherein the transfer unit uses an intermediate transfer method in which a toner image formed on the circumferential surface of the electrophotographic photoreceptor is transferred indirectly to an image receiving medium via an intermediate transfer member.

12. A process cartridge comprising an electrophotographic photoreceptor and at least one selected from the group consisting of a charging unit, a development unit, a transfer unit, and a cleaning unit, wherein:

the process cartridge is attachable to an image forming apparatus and detachable from the image forming apparatus;

the image forming apparatus conducts charging, exposure, development, and transfer while moving a circumferential surface of the electrophotographic photoreceptor in a predetermined direction;

the process cartridge further comprises a controlling unit which controls a moving velocity of the circumferential surface of the electrophotographic photoreceptor so that a time required for processes from charging to development is changeable;

the electrophotographic photoreceptor includes an undercoat layer and a photosensitive layer;

the undercoat layer has a thickness of 15 to 50 μm and includes a metal oxide particle and an acceptor compound having a hydroxyl group, wherein the acceptor compound having the hydroxyl group is selected from the group consisting of monohydroxyanthraquinone, trihydroxyanthraquinone and aminohydroxyanthraquinone;

wherein the acceptor compound is reacted with the metal oxide particle; and wherein the metal oxide particle was subjected to a surface treatment with a coupling agent.

* * * * *